US010098469B2

(12) United States Patent
Szonyi

(10) Patent No.: US 10,098,469 B2
(45) Date of Patent: Oct. 16, 2018

(54) PIVOTING SEAT BENCH ASSEMBLY

(71) Applicant: Anna Szonyi, Dubai (AE)

(72) Inventor: Anna Szonyi, Dubai (AE)

( * ) Notice: Subject to any disclaimer, the term of this patent is extended or adjusted under 35 U.S.C. 154(b) by 282 days.

(21) Appl. No.: 15/084,178

(22) Filed: Mar. 29, 2016

(65) Prior Publication Data

US 2016/0302581 A1 Oct. 20, 2016

Related U.S. Application Data

(60) Provisional application No. 62/139,876, filed on Mar. 30, 2015.

(51) Int. Cl.

| | |
|---|---|
| ***B60N 2/02*** | (2006.01) |
| ***A47C 11/00*** | (2006.01) |
| ***A47C 1/027*** | (2006.01) |
| *A47C 7/40* | (2006.01) |
| *A47C 7/02* | (2006.01) |
| *A47C 3/18* | (2006.01) |

(52) U.S. Cl.

CPC ..... *A47C 11/00* (2013.01); *A47C 1/027* (2013.01); *A47C 3/18* (2013.01); *A47C 7/02* (2013.01); *A47C 7/40* (2013.01)

(58) Field of Classification Search

CPC ..... A47C 11/00; A47C 1/027; A47C 7/02; A47C 7/40; A47C 3/18

USPC ..... 297/92–95, 233

See application file for complete search history.

(56) References Cited

U.S. PATENT DOCUMENTS

| | | | | | |
|---|---|---|---|---|---|
| 221,141 | A * | 10/1879 | Smith | A47C 1/028 | 297/118 |
| 358,454 | A * | 3/1887 | Johnson | A47C 1/028 | 297/327 |
| 2,674,302 | A * | 4/1954 | McMorran, Jr. | A47C 1/028 | 297/1 |
| 3,743,353 | A * | 7/1973 | Lupinsky | A47B 85/00 | 297/411.42 |
| 4,235,473 | A * | 11/1980 | Aginar | A47C 4/022 | 297/440.19 |
| 4,322,109 | A * | 3/1982 | Thebaud | A47C 4/022 | 108/118 |
| 4,561,692 | A * | 12/1985 | Yestadt | A47B 9/00 | 108/12 |
| 5,056,849 | A * | 10/1991 | Norris, Jr. | B60N 2/203 | 296/65.05 |
| 6,174,585 | B1 * | 1/2001 | Miles | A47B 85/00 | 297/118 |
| 6,824,221 | B1 * | 11/2004 | Tiffany, III | A47C 4/022 | 297/451.4 |
| 8,870,277 | B2 * | 10/2014 | Yestadt | A47C 3/00 | 297/1 |
| 9,756,947 | B2 * | 9/2017 | Lee | A47C 7/563 | |

(Continued)

*Primary Examiner* — Syed A Islam

(74) *Attorney, Agent, or Firm* — Hayes Soloway PC

(57) ABSTRACT

There is provided a pivoting bench comprising a central spine extending along a longitudinal axis; seat slats configured to be mounted to the central spine and to rotate about the longitudinal axis for alternating a seating surface formed by at least a part of the seat slats from a first side of the bench to a second side of the bench opposite the first side with respect to the longitudinal axis of the central spine; and a support structure for supporting the central spine, the boomerang-shaped seat slats and the bench to the ground. The seat slats are boomerang shaped seat slats.

19 Claims, 51 Drawing Sheets

(56) References Cited

U.S. PATENT DOCUMENTS

| | | | | |
|---|---|---|---|---|
| 2009/0140568 | A1* | 6/2009 | Chan | A47C 7/024<br>297/452.11 |
| 2013/0033074 | A1* | 2/2013 | Daly | A47C 1/146<br>297/183.1 |
| 2017/0127841 | A1* | 5/2017 | Lee | A47C 7/563 |
| 2017/0238707 | A1* | 8/2017 | Leathead | A47B 85/04 |

* cited by examiner

PIVOTING SEAT BENCH ASSEMBLY

FIELD OF THE INVENTION

The present invention relates generally to benches, and more particularly to a pivoting bench.

BACKGROUND OF THE INVENTION

A public seating creates a comfortable, useable, and active public environment where people can rest, socialize, read, or people-watch. Seating creates places where people can see and be seen. This most common furniture used for public seating is benches. Benches of various shapes and sizes are known in the art. Benches have been designed to provide comfortable seating space in public places. Various people friendly designs are available and can be seen installed in malls, airports lounges and parks etc. However, one of main disadvantage of keeping a bench in public places is that they usually utilize a large floor area. The benches of usual size will allow only four to six people to sit comfortably. The benches which are designed to accommodate more people will not be suitable for area where free floor area is a matter of concern. Another major disadvantage of benches is that they allow sitting only in one particular direction. If both the sides of public area have activities of interest then the demand of the area would be to allow people to sit facing in both the directions. This is however not possible with a single bench assembly where the siting position is unidirectional. The available solution to this problem is either to put two benches back to back facing in either directions or to join two benches sideways such that one bench faces in one direction and the other bench in other direction. All other available designs are usual modification of these two basic concepts. However, both these concepts have a major disadvantage of covering a large floor area and use of more number of benches for both side sitting.

SUMMARY OF THE INVENTION

Therefore, it is an object of the present invention to provide a pivoting seat bench assembly for public facilities which would allow multiple applications, while being simple to produce and capable of being rotated to allow each side sitting along the central spine and which would overcome the above mentioned drawbacks offering some added advantages.

As a first aspect of the present invention, there is provided a pivoting seat bench assembly comprising:

two or more stands having an angled configuration;

a plurality of seating slats;

a central spine structure for interlinking said slats along the central spine axis and connected to said stands;

slat-rotating component for rotating the said slats around the central spine structure; and seating angle position stopper.

Preferably, the stands are placed at regular intervals to hold the seating slats and the central spine structure. The stand preferably has angular V shaped configuration such that the two legs of the stand are extended towards the floor to form the ground support for the bench assembly and the central bend of said stand is provided with a hole to support the central spine structure.

Preferably, the plurality of seating slats is arranged along the central spine axis in such a manner that they together form a seating surface and a back support. The seating slats are preferable boomerang shaped. However, the seating slats can be of any shape suitable for making a seating surface and a back support such as L-shape, J-shape and the like. Preferably, the bend of the seating slat is provided with a hole to support the central spine structure.

Preferably, central spine structure is a cylindrical rod structure which interlinks the seating slats along the central spine axis at regular intervals such that said slats are sitting on the cylindrical rod and can be mechanically rotated around the central spine axis such that the relative rotational displacement of the slats is perpendicular to the central spine axis with the rotation being centered on the central spine axis. However, central spine structure of any suitable shape which allows a rotating motion for the said slats is within the scope of the invention.

Preferably, slat-rotating component is attached to each seating slat such that it forms a mechanical rotation joint between the central spine structure and the seating slats.

The slat-rotating component further comprises a sleeve component and a rotating bearing structure wherein the sleeve component comprises an outer cladding sheet, a movement control slot and a movement control pin and the rotating bearing structure comprises of an external cladding and an internal bearing physically connected to each other such that the internal bearing is physically connected from outside to the external cladding and forms a central spine hole on the inside to allow the central spine structure to pass through. The outer cladding sheet further comprises a hole to support the central spine structure.

Preferably, the slat-rotating component is physically connected to the seating slat such that the said slat is inserted in the cavity of the sleeve component such that the hole of the said slats coincides with the hole of the sleeve component and the rotating bearing structure is placed in the said slats such that the external cladding is firmly fixed into the hole of the seating slat and the central spine hole of the internal bearing is around the central spine structure to allow a mechanical rotational displacement of the seating slats.

Preferable, the seating angle position stoppers includes two or more pipe/rod structures placed symmetrically along the central spine axis to provide structural support to seating slats such that the said slats rest on the pipe/rod structures at the seating level angle to form the seat surface. The seating angle position stopper is preferably fastened on stands by suitable means.

As a second aspect of the present invention, there is provided a method of mechanically rotating the one or more of the seating slats at any rotational displacement angle ranging from 0° to 90° such that rotational displacement of the seating slates is perpendicular to the central spine axis with the rotation being centered on the central spine axis.

Preferably, the rotational displacement of one seating slat is mechanically transferred to the adjacent seating slat by means of movement control pins which allows the adjacent seating slat to rotate at an angular rotational angle which depends on the size of the movement control slot. This rotational displacement is gradually transferred from one seating slat to another seating slat thereby allowing each adjacent slat to gradually rotate in the direction of rotation at a gradually reducing angular rotational angle such that when each adjacent seating slat completes the maximum rotational displacement of 90° the angular rotational angle between the adjacent slat and the previous slat become 0°.

As a further aspect of the invention, there is provided a pivoting bench comprising:

a central spine extending along a longitudinal axis;

seat slats configured to be mounted to the central spine and to rotate about the longitudinal axis for alternating a seating surface formed by at least a part of the seat slats from a first side of the bench to a second side of the bench opposite the first side with respect to the longitudinal axis of the central spine; and a support structure for supporting the central spine, the seat slats and the bench to the ground.

Preferably, the seat slats are boomerang-shaped seat slats.

Preferably, the pivoting bench further comprises a stopper respectively for each side of the bench mountable on the support structure and extending along the longitudinal axis for stopping and supporting the seat slats when they reach a sitting position.

Preferably, the seat slats are configured to have a predefined displacement angle range therebetween while rotating.

Preferably, the seat slats comprise pins and slots adapted to link the seat slats between each other in a manner to enable a coordinated movement therebetween according to the predefined displacement angle range.

Preferably, each seat slat has two pins on a first side of the slat adjacent a first proximity slat and two slots on another side of the slat adjacent a second proximity slat, wherein the pins of the slat are adapted to engage the slots of the first proximity slat and the slots of the slat are adapted to engage the pins of the second proximity slat.

Preferably, the seat slats are adapted to be coupled to the central spine using slat rotating components.

Preferably, the seat slats have bend portions, and wherein the slat rotating components are adapted to enrobe the bend portions of the slats.

Preferably, the predefined displacement angle range is 0-8 degrees.

Preferably, the seat slats are adapted to rotate between 0 and 90 degrees.

Preferably, the 90 degrees rotation of the seat slats results in shifting the seating surface formed by the rotated seat slats from the first side of the bench to the second side of the bench.

Preferably, the central spine consists of a cylindrical shaft extending along the longitudinal axis.

Preferably, the stoppers consist of cylindrical shafts extending along the longitudinal axis.

Preferably, the support structure comprises two or more stands adapted to sit on the ground and to support the central spine and the stoppers.

Preferably, the seat slats are divided into 2 or more groups, such that each group of slats are interlinked independently of the other groups for forming respective 2 or more sitting areas within the bench.

Preferably, the plurality of seating slats are adapted to be connected together in such a manner that the rotation of one or more seat slats triggers the rotation of one or more other seat slats with a predefined angular displacement there between.

Preferably, the seat slats are adapted to rotate between 0 and 90 degrees and wherein a 90 degrees rotation of the seat slats results in shifting the seating surface formed by the rotated seat slats from the first side of the bench to the second side of the bench.

Preferably, the displacement angle range defined between the slats enable for the slats located adjacent the 90 degrees rotated ones to form a gradually inclined slat separator.

Preferably, the seat slats are adapted to be rotated such that 2 or more sitting areas are formed separated by gradually inclined slat separators within the bench.

Preferably, the seat slats are boomerang-shaped seat slats.

BRIEF DESCRIPTION OF THE DRAWINGS

The subject matter that is regarded as the invention is particularly pointed out and distinctly claimed in the claims at the conclusion of the specification. The foregoing and other aspects, features, and advantages of the invention are apparent from the following detailed description taken in conjunction with the accompanying drawings in which:

DETAILED DESCRIPTION OF THE INVENTION

Figure 1:
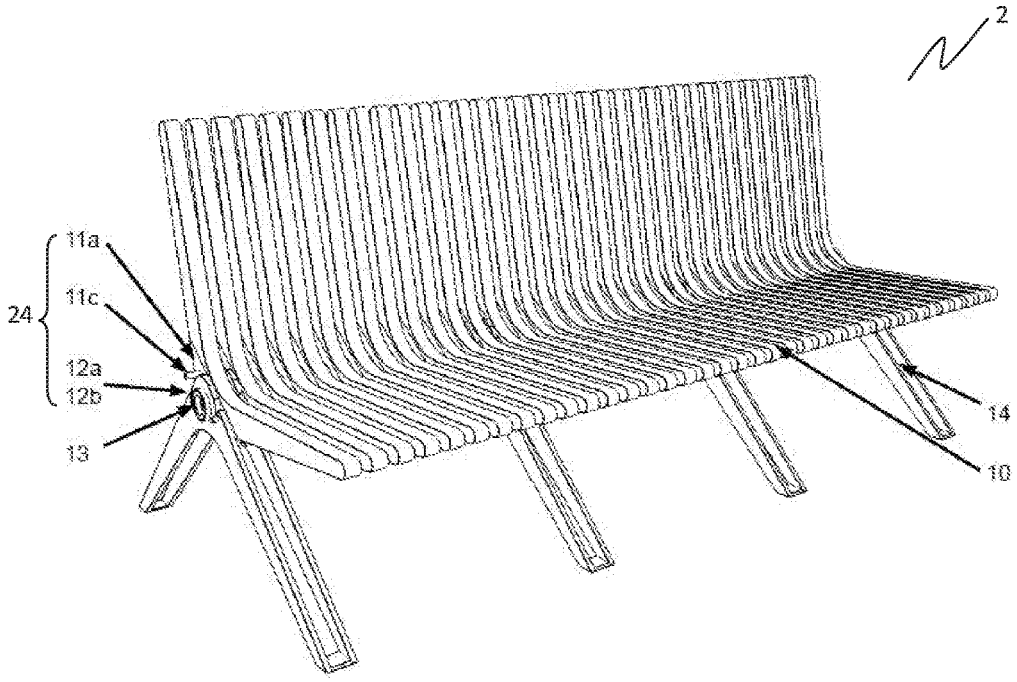
FIG. 1 is a perspective view of a seat bench assembly according to one embodiment of the present invention.
Figure 2:
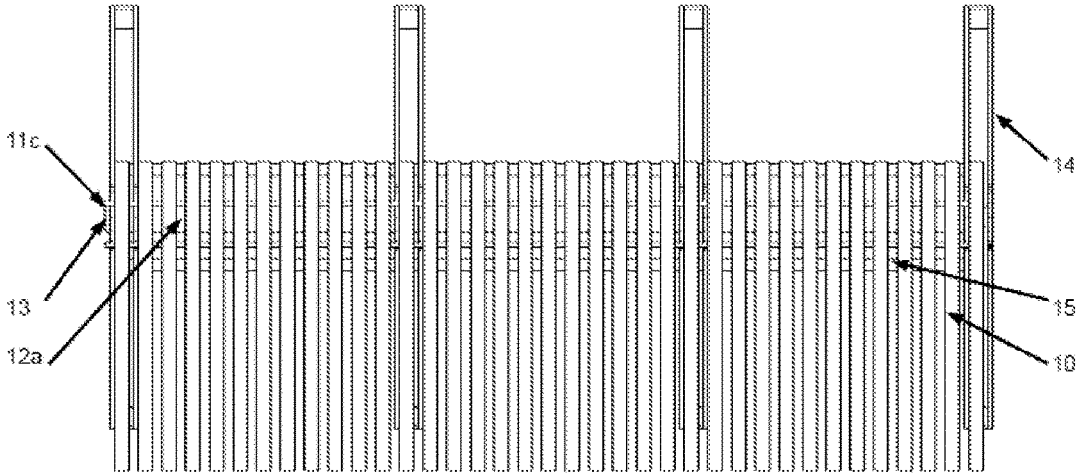
FIG. 2 is a plan view of a seat bench assembly according to first embodiment of the present invention.
Figure 3:
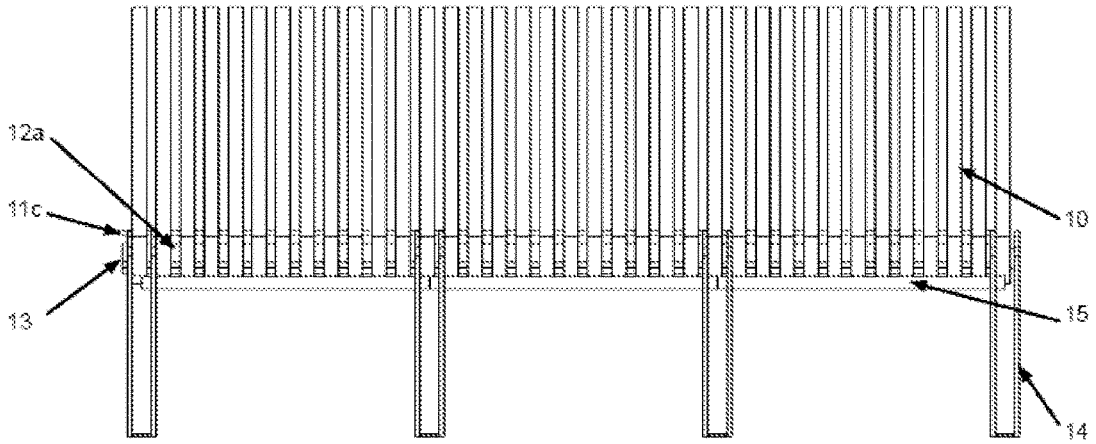
FIG. 3 is a front elevation view of a seat bench assembly according to one embodiment of the present invention.
Figure 4:
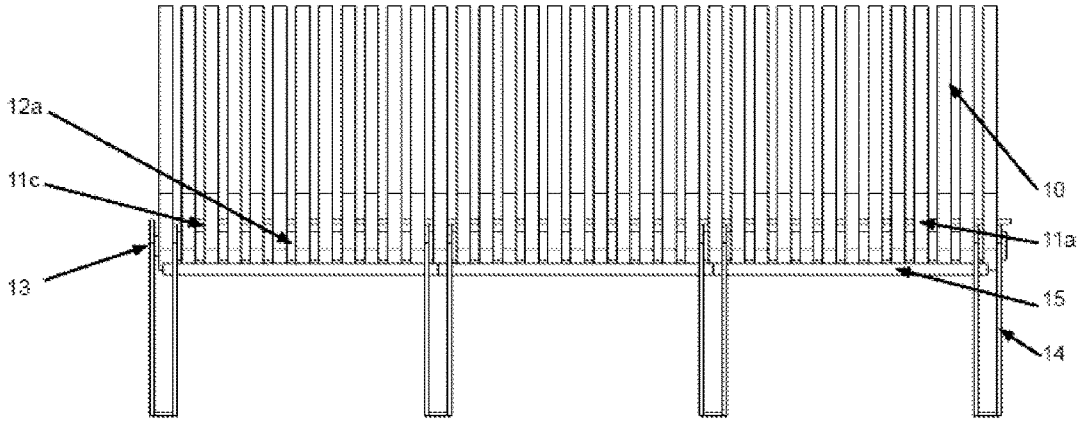
FIG. 4 is a back elevation view of a seat bench assembly according to one embodiment of the present invention.
Figure 5:
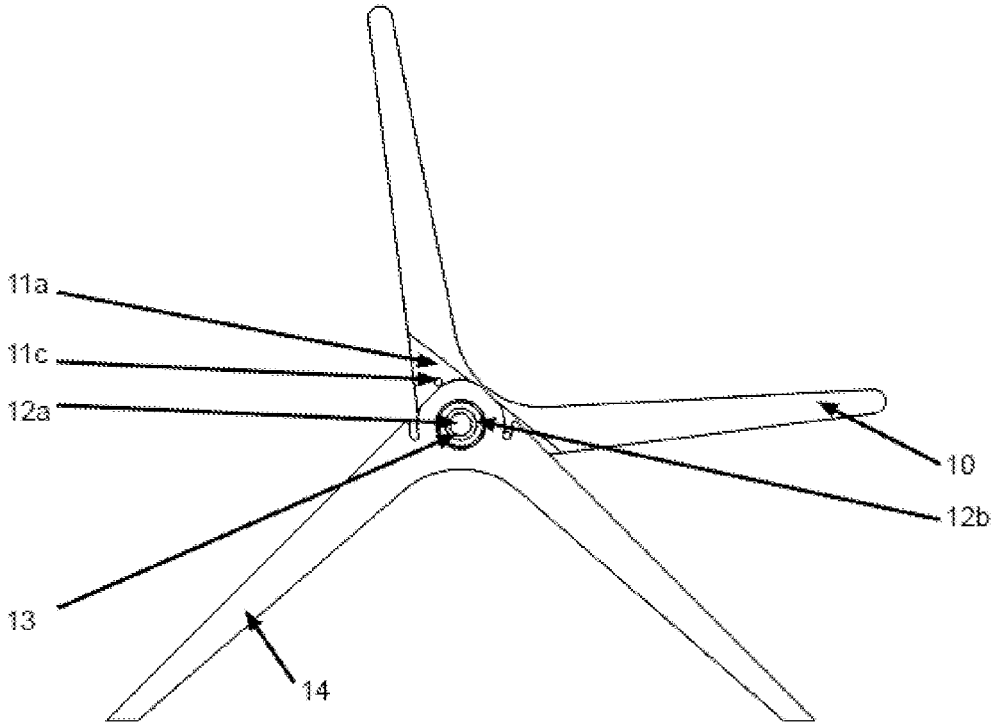
FIG. 5 is a first side elevation view of a seat bench assembly according to an embodiment of the present invention.
Figure 6:
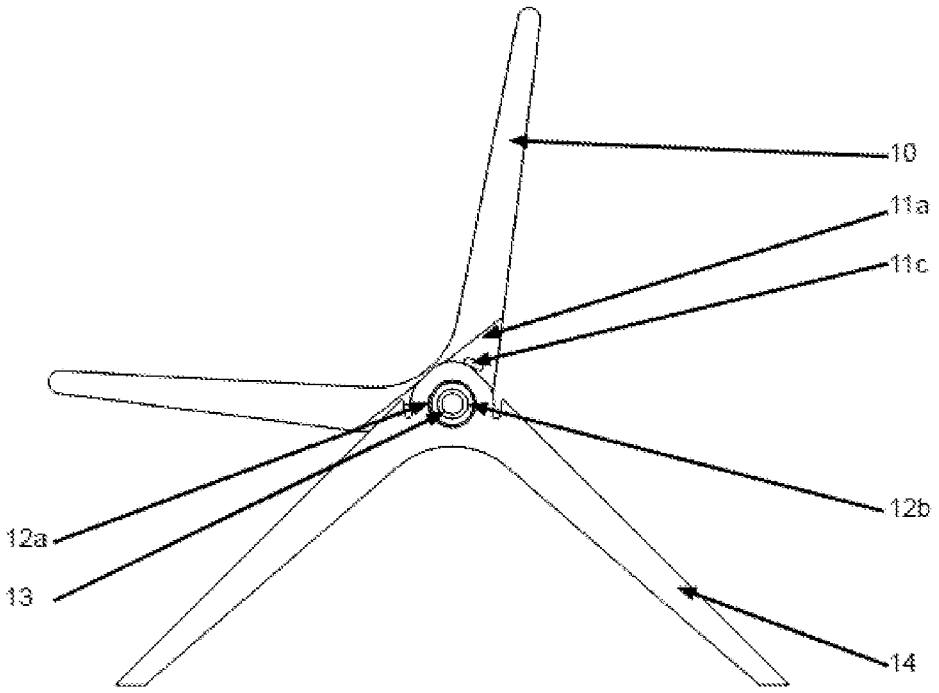
FIG. 6 is a second side elevation view of a seat bench assembly according to an embodiment of the present invention.
Figure 7:
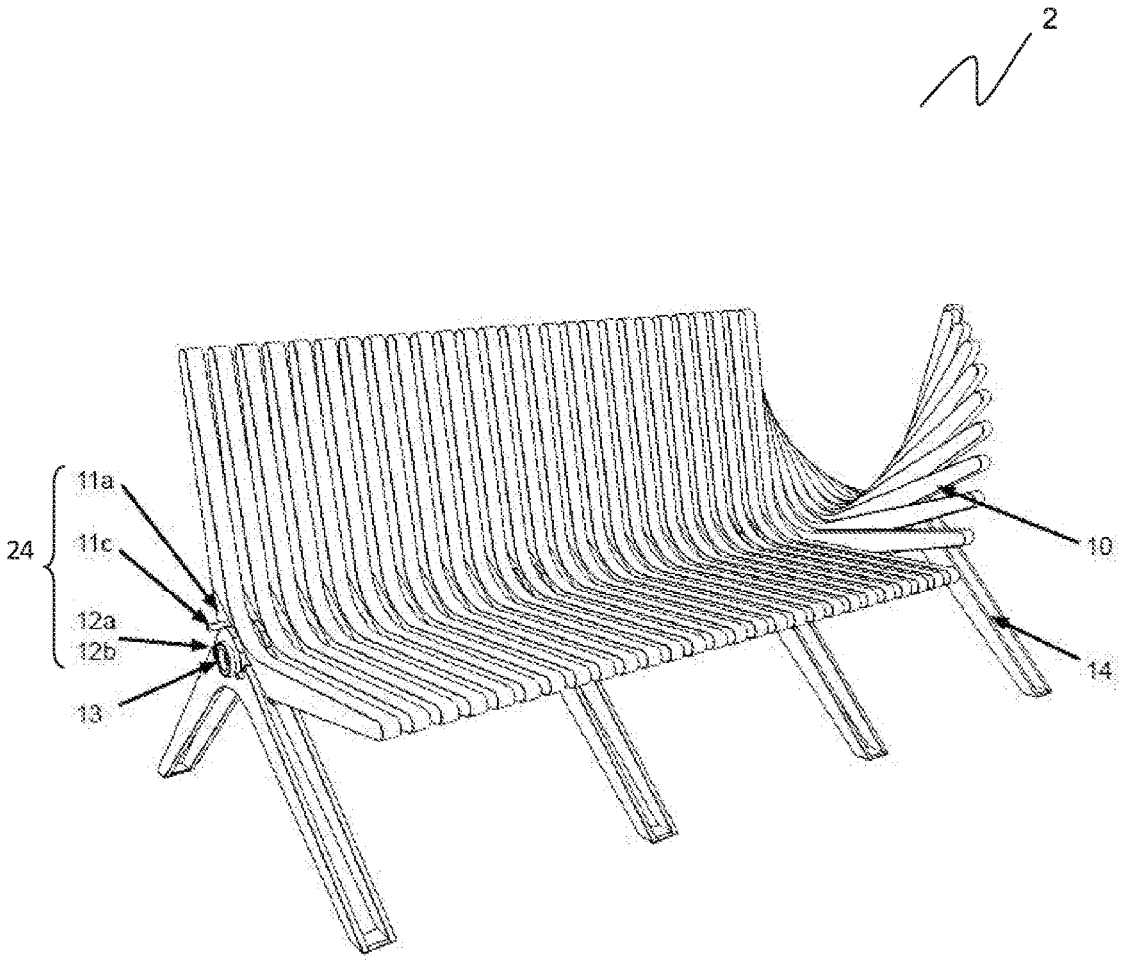
FIG. 7 is a perspective view of a seat bench assembly according to another embodiment of the present invention.
Figure 8:
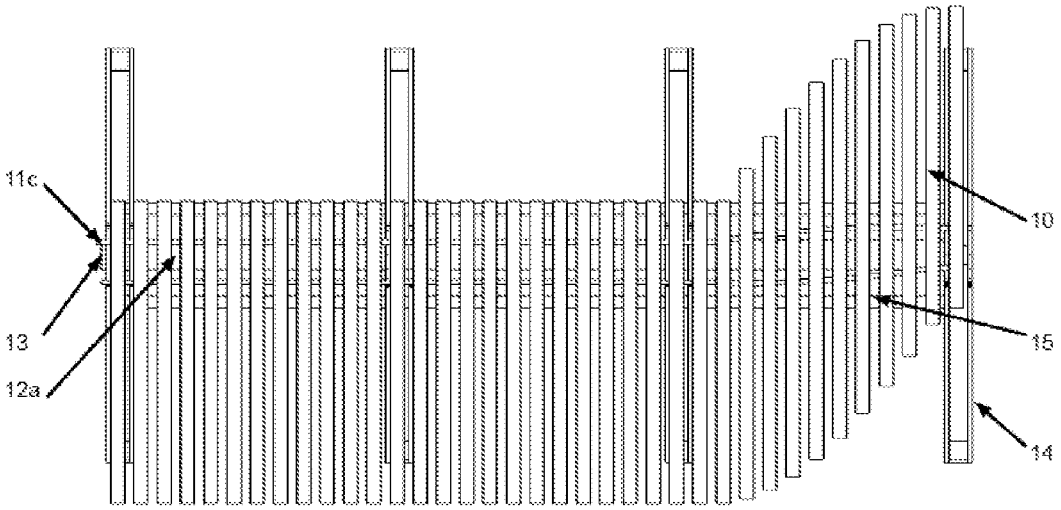
FIG. 8 is a plan view of a seat bench assembly according to another embodiment of the present invention.
Figure 9:
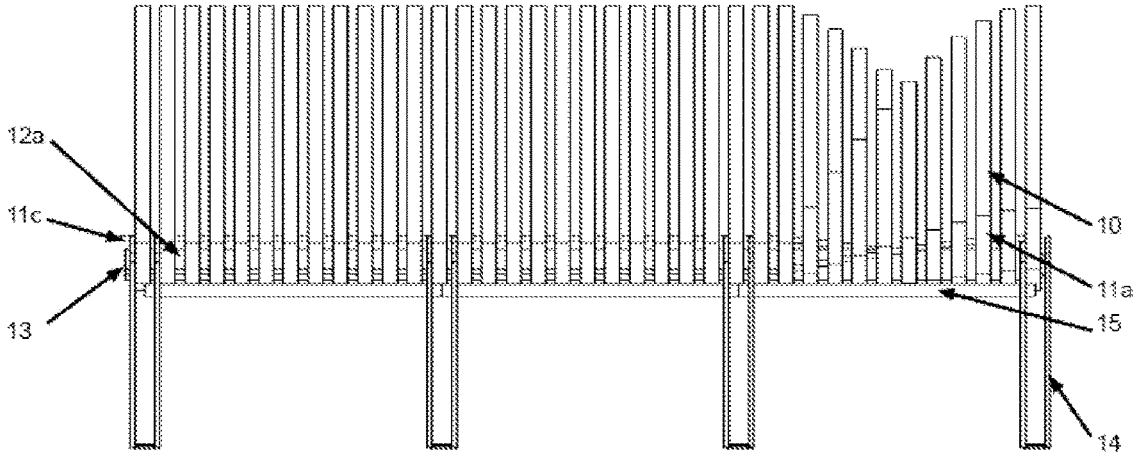
FIG. 9 is a front elevation view of a seat bench assembly according to another embodiment of the present invention.
Figure 10:
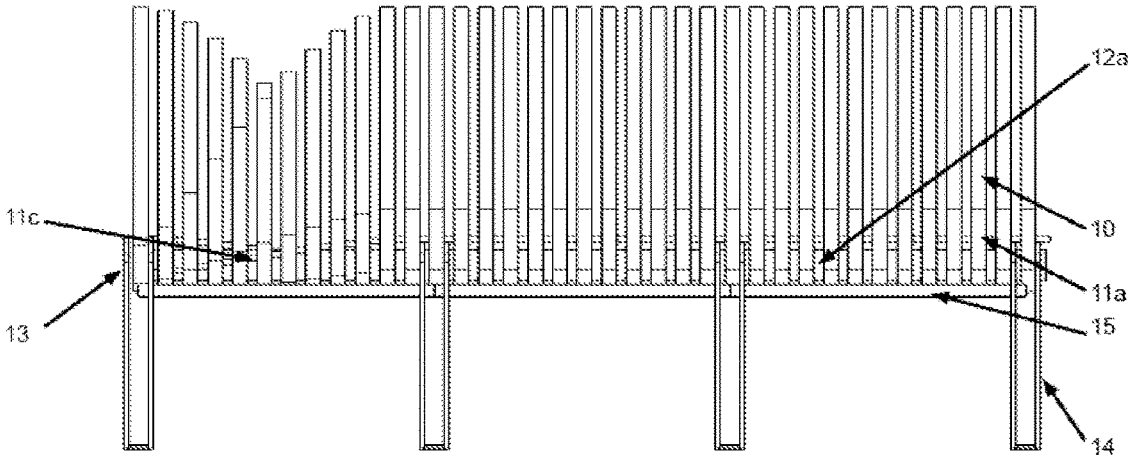
FIG. 10 is a back elevation view of a seat bench assembly according to another embodiment of the present invention.
Figure 11:
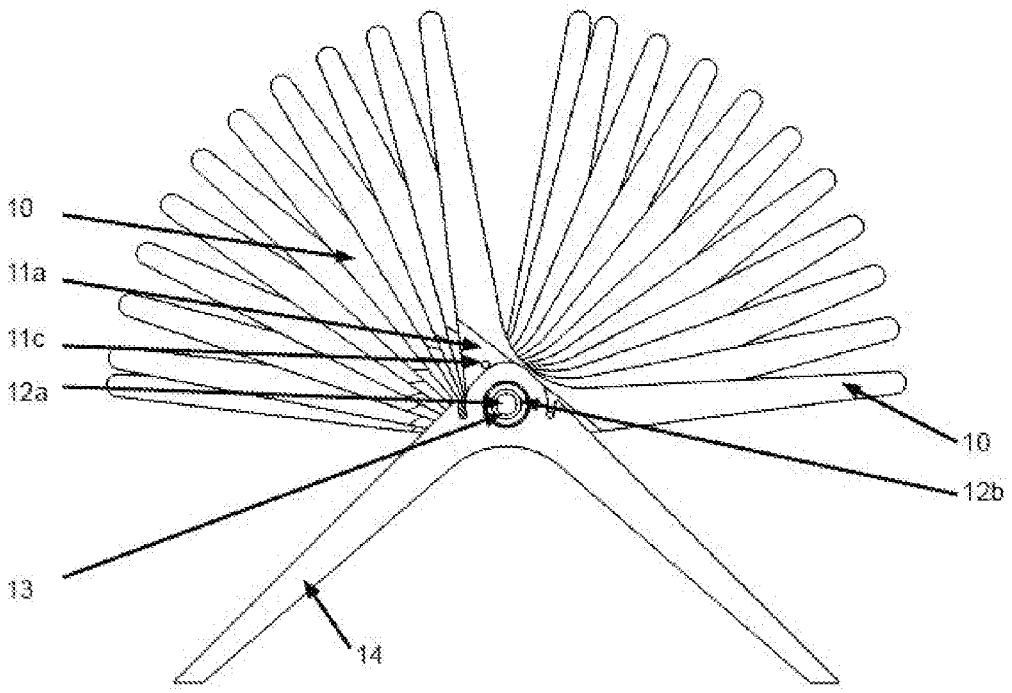
FIG. 11 is a first side elevation view of a seat bench assembly according to another embodiment of the present invention.
Figure 12:
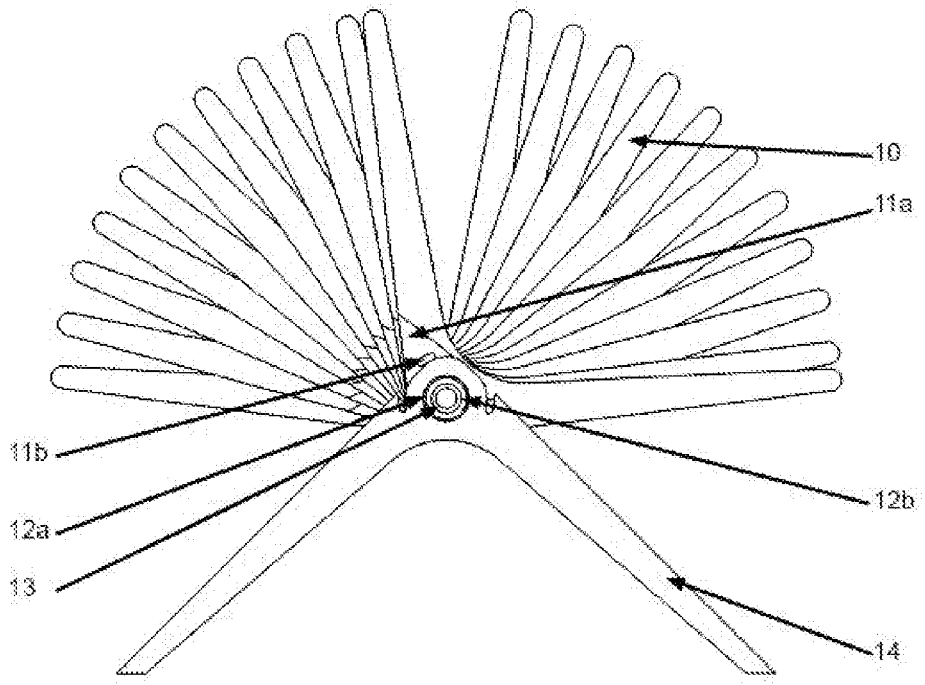
FIG. 12 is a second side elevation view of a seat bench assembly according to another embodiment of the present invention.
Figure 13:
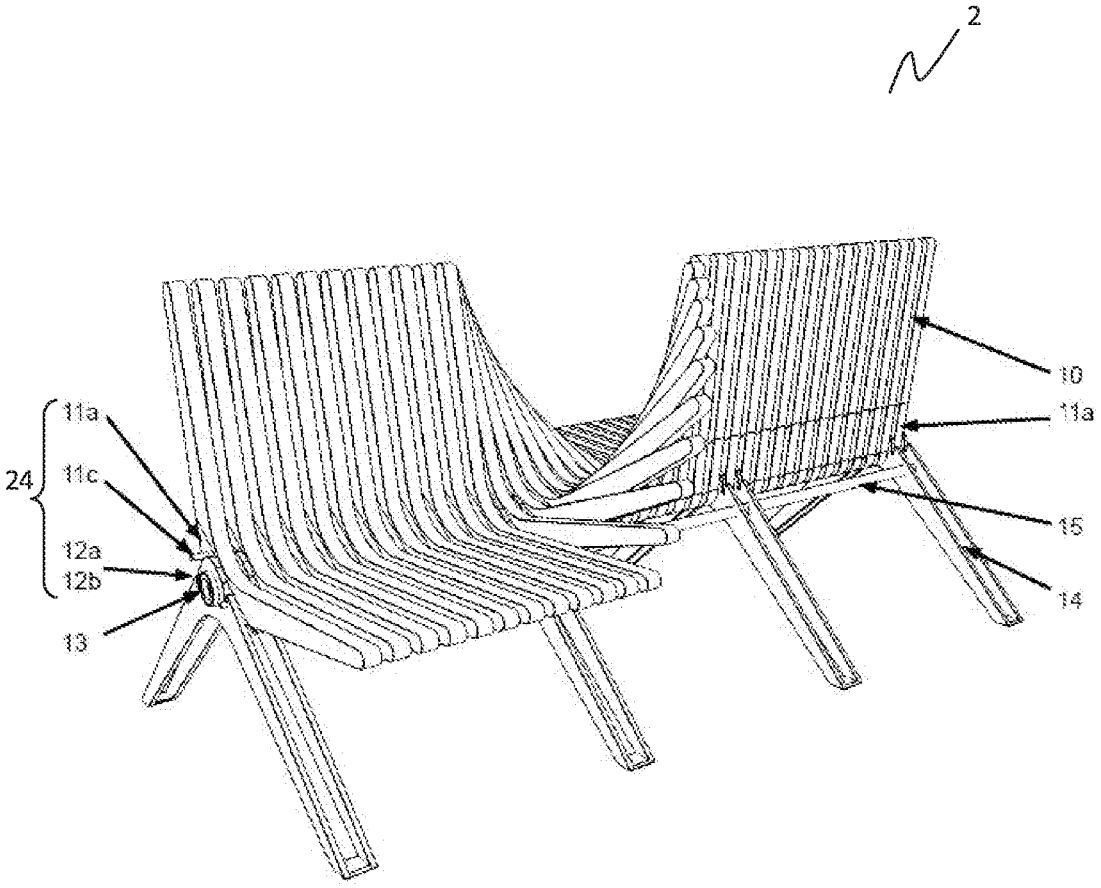
FIG. 13 is a perspective view of a seat bench assembly according to yet another embodiment of the present invention.
Figure 14:
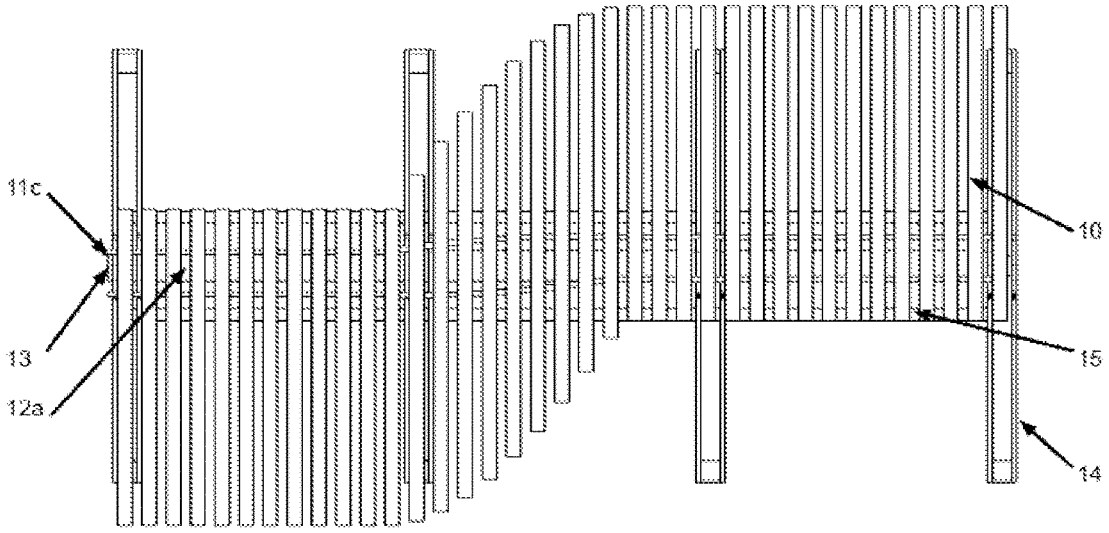
FIG. 14 is a plan view of a seat bench assembly according to yet another embodiment of the present invention.
Figure 15:
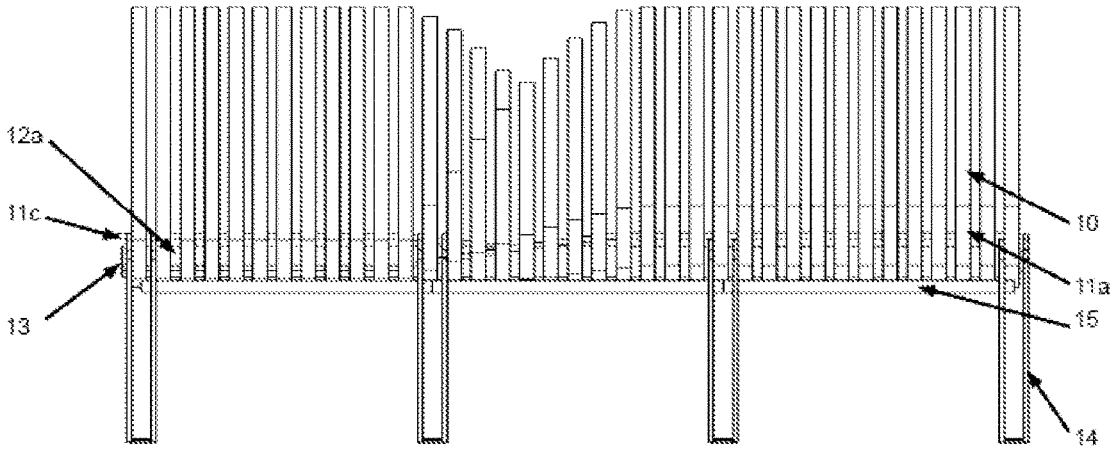
FIG. 15 is a front elevation view of a seat bench assembly according to yet another embodiment of the present invention.
Figure 16:
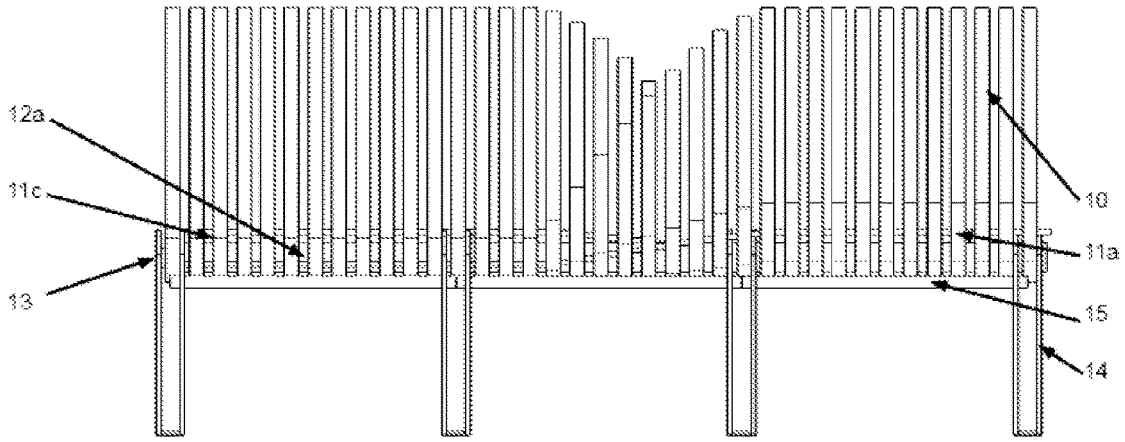
FIG. 16 is a back elevation view of a seat bench assembly according to yet another embodiment of the present invention.
Figure 17:
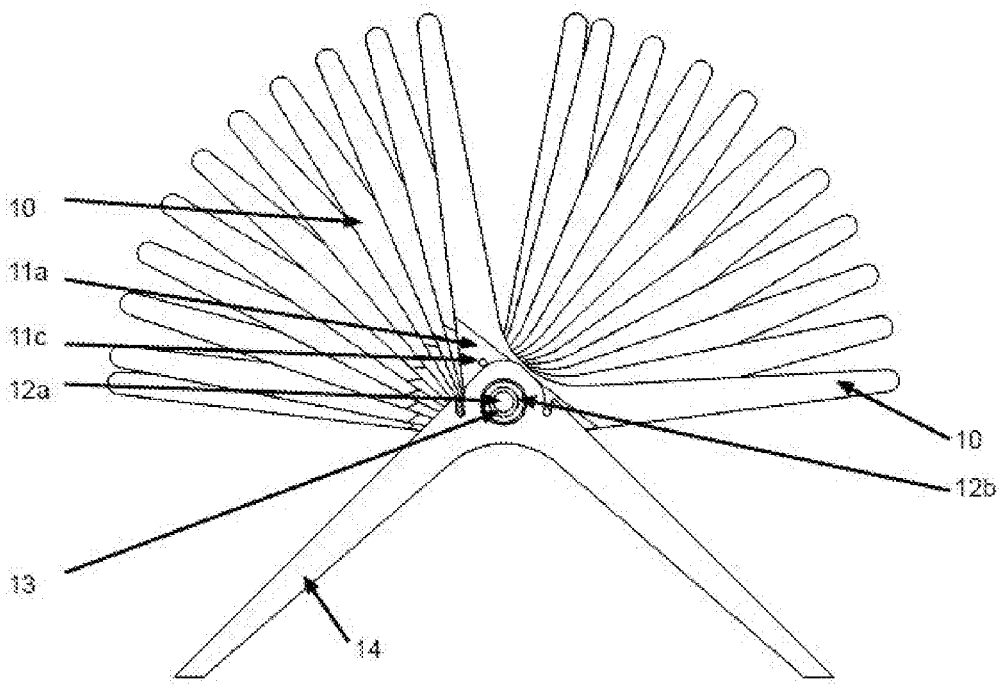
FIG. 17 is a first side elevation view of a seat bench assembly according to yet another embodiment of the present invention.
Figure 18:
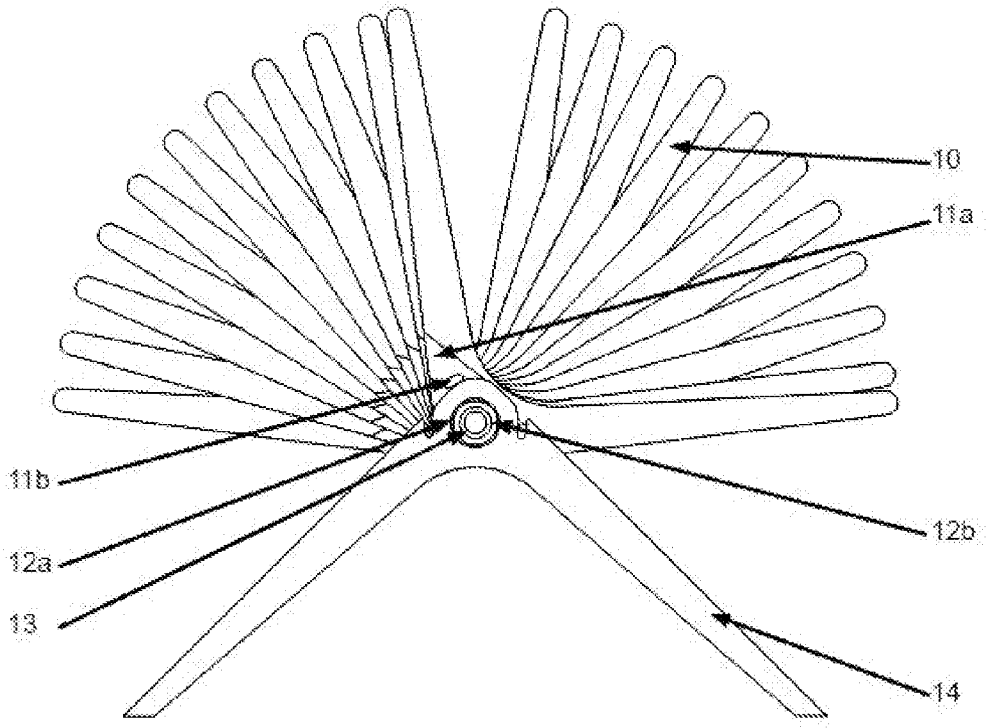
FIG. 18 is a second side elevation view of a seat bench assembly according to yet another embodiment of the present invention.
Figure 19:
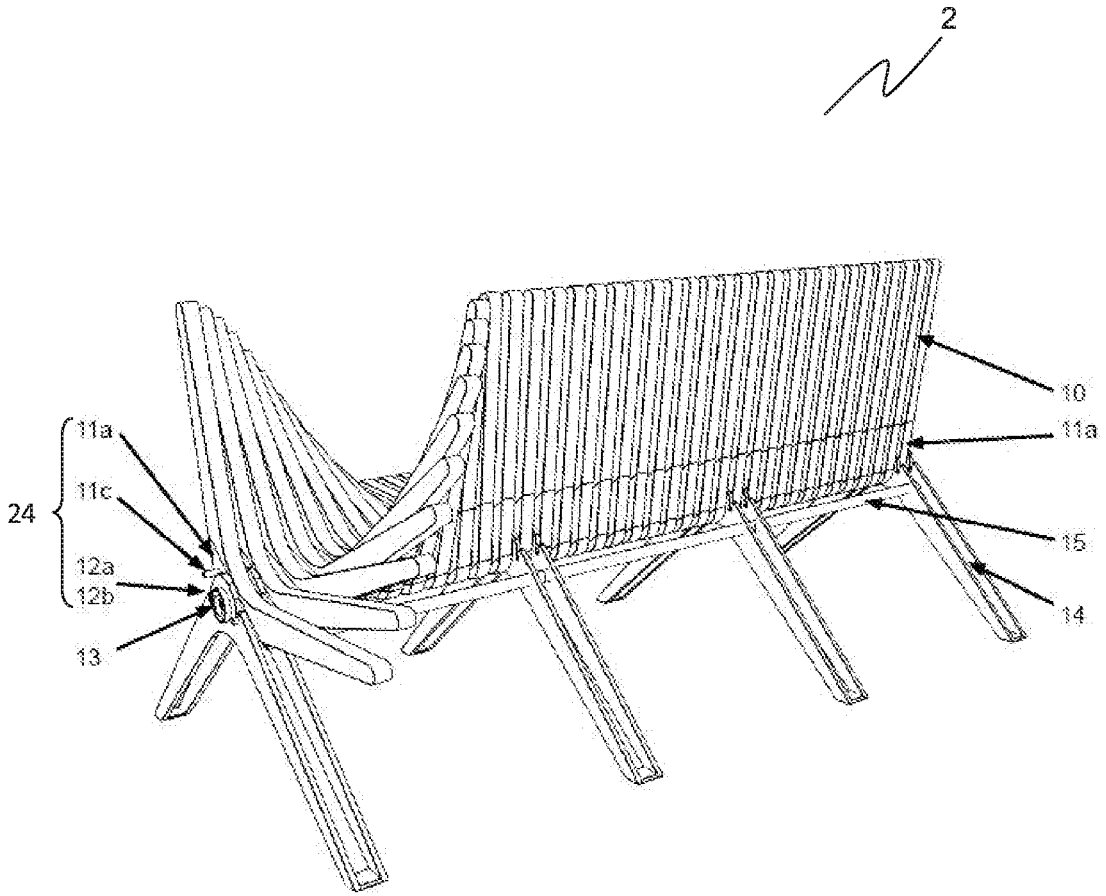
FIG. 19 is a perspective view of a seat bench assembly according to another embodiment of the present invention.
Figure 20:
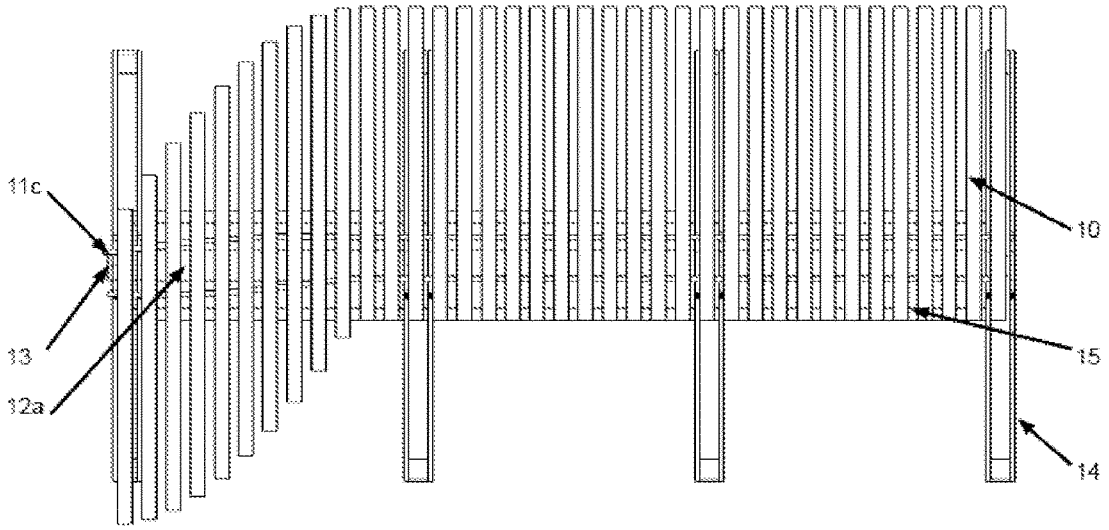
FIG. 20 is a plan view of a seat bench assembly according to another embodiment of the present invention.
Figure 21:
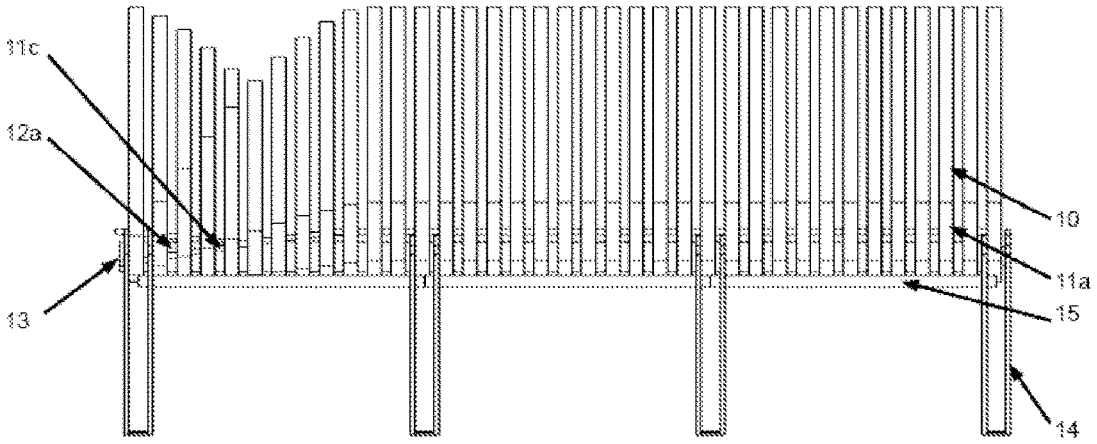
FIG. 21 is a front elevation view of a seat bench assembly according to another embodiment of the present invention.
Figure 22:
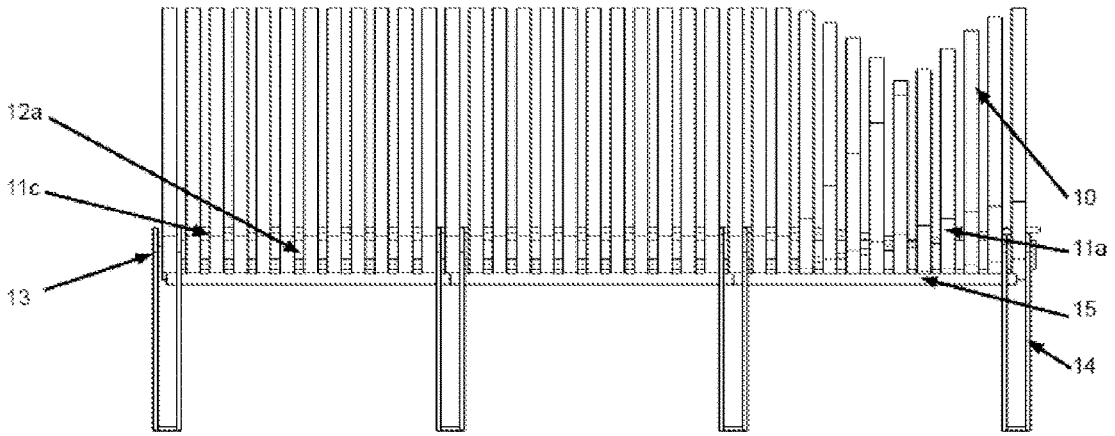
FIG. 22 is a back elevation view of a seat bench assembly according to another embodiment of the present invention.
Figure 23:
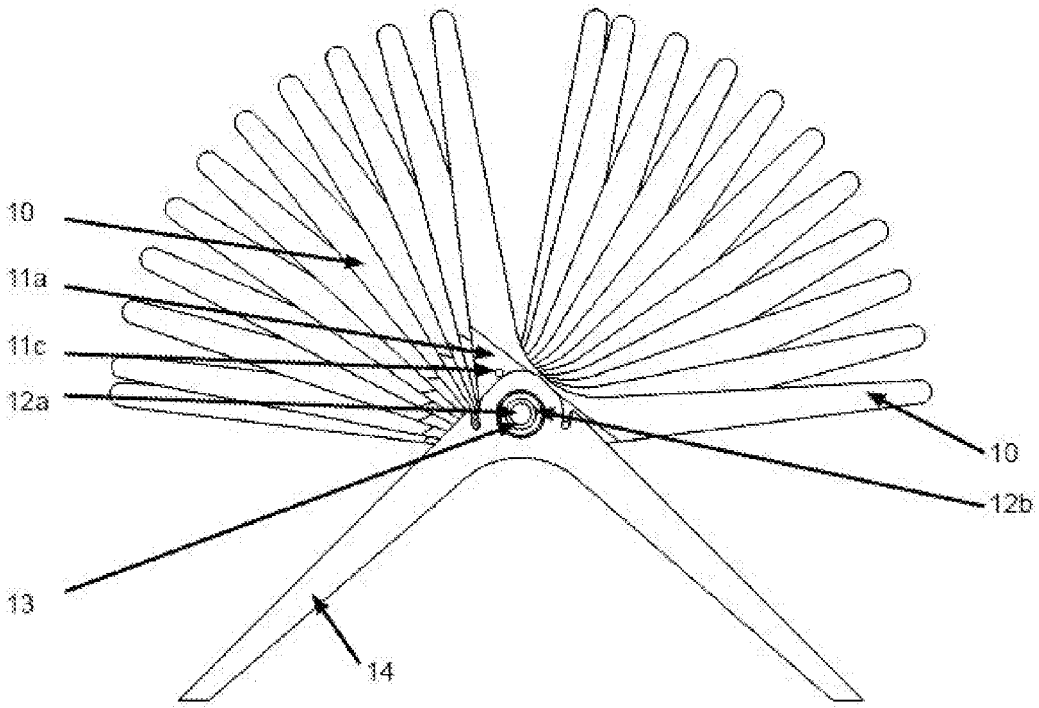
FIG. 23 is a first side elevation view of a seat bench assembly according to another embodiment of the present invention.
Figure 24:
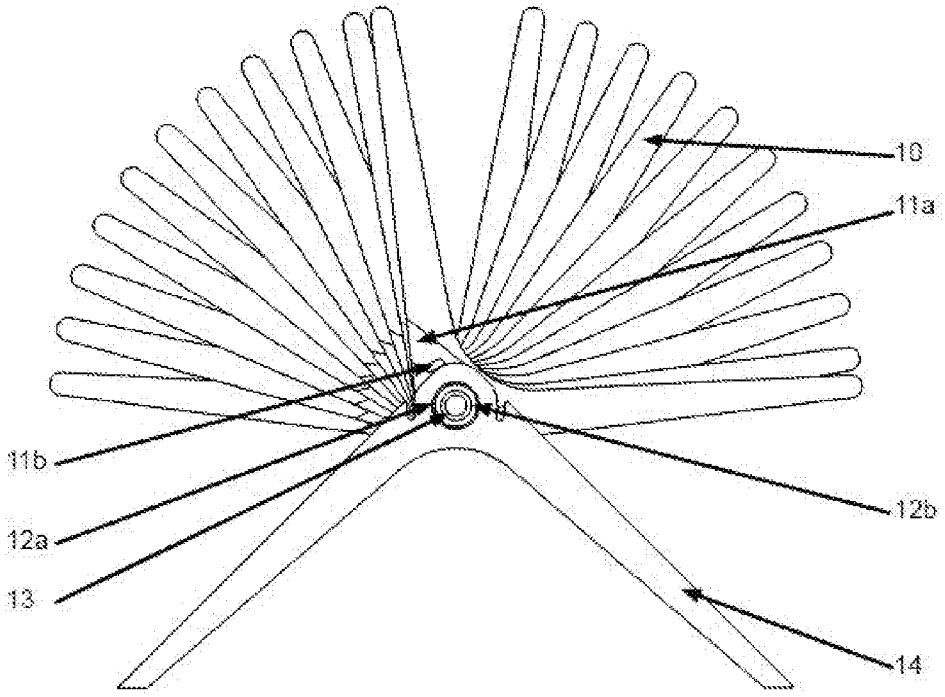
FIG. 24 is a second side elevation view of a seat bench assembly according to another embodiment of the present invention.

The foregoing descriptions of specific embodiments of the present disclosure have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

The pivoting seat bench assembly 2, shown in the drawings, is designed for providing seating facility in public facilities such as parks, streets, waiting rooms, malls, waiting rooms and lounges of airport, subways or the like comprises two or more stands 14 having an angled configuration, a plurality of seating slats 10, a central spine 13 for interlinking said slats 10 along the central spine axis 20 and mounted to said stands 14, a slat-rotating component 24 respectively for each seating slat 10 for enabling a coordinated rotation of the slats 10 around the central spine 13 about the central spine axis 20; and a seating angle position stopper 15 for stopping the rotation of the seating slats 10 and supporting these for forming the seating surface.

The term "bench assembly" as used herein is to be understood to include any sitting installation/furniture, swings and other devices having a seat and a back upon which people sit. The bench assembly may further include a table and other suitable fixtures without deviating from the overall scope of the invention.

Referring to FIGS. 1-40*c*, the pivoting seat bench assembly 2 comprises a plurality of seating slats 10 mounted to the central spine 13 along the central spine axis 20 such that the plurality of seating slats 10 form the seating surface and back support. The seating slats 10 are in the form of boomerangs having central bend portions having holes 40 for receiving and holding the central spine 13. The central spine 13 is mounted in such a manner that it is supported by two or more stands 14, preferably placed at regular intervals.

Each stand 14 preferably has an angular V shaped structure with a central bend portion and two legs adapted to be extended towards the floor surface to form the ground support for the seat bench assembly 2. The central bend portions of the stands 14 have holes 50 for receiving and holding the central spine 13, two or more slots 26 for receiving and holding the seating angle position stoppers 15, and two or more cuts 28 for controlling the rotation of the slat-rotating component 24.

The slat rotating component 24 comprises a sleeve component 11 having outer cladding sheet 11*a*, movement control slots 11*b* and movement control pins 11*c*. The outer cladding sheet 11*a* has a hole 60 concentric with the hole 40 of the seating slat 10 for receiving holding the central spine 13. The movement control slots 11*b* are preferably two slots 11*b* located at a first side of the outer cladding sheet 11*a*. The movement control pins 11*c* are preferably two movement control pins 11*c* located at a second side of the cladding sheet 11*a* opposing the first side. When the seat slats 10 are mounted on the central spine 13 along the central spine axis 20, the movement control pins 11*c* associated with first seat slats 10 are secured within the movement control slots 11*b* of second seat slats 10 adjacent to the first seat slats 10 from a first side along the central spine axis 20. The movement control slots 11*c* associated with the first seat slats 10 receive and secure the movement control pins 11*b* of third seat slats 10 adjacent the first seat slats 10 from a second side opposite the first side along the central spine axis 20. This interlinking/interconnection between the seat slats 10 allow for a controlled and synchronized movement of the seat slats 10 such that when one seat slat 10 is rotated, the adjacent seat slats 10 are rotated in consequence.

The sleeve component 11 is adapted to be coupled to the seating slats 10 such the sleeve component 11 enrobes the seating slat 10 bending portion. The sleeve component 11 has a cavity defined by the walls of the sleeve component 11 which is adapted to receive and enrobe the bending portion of the seating slat 10 such that the hole 40 of seat slat 10 coincides with the hole 60 of the outer cladding sheet 11*a*.

The plurality of the seat slats 10 are mounted on the central spine 13 along the central spine axis 20 such that the plurality of the seat slats 10 are interconnected with each other in such a manner that the movement control pin 11*c* associated to one seating slat 10 protrudes into the movement control slot 11*b* associated to an adjacent seating slat 10.

The slat rotating component 24 further comprises a rotating bearing structure 12 having an external cladding 12*a* and an internal bearing 12*b*. The rotating bearing structure 12 is adapted to be positioned inside the coinciding holes 40 & 60 of the seat slats 10 and sleeve component 11 such that the external cladding 12*a* is firmly fixed to the coinciding holes 40 & 60 and the internal bearing 12*b* is physically connected to the external cladding 12*a* from the outside and forms a central spine hole 30 on the inside to allow the central spine 13 to pass through.

A slat rotating component 24 is coupled to each one of the seating slats 10 to form a mechanical rotation joint between the central spine 13 and the seat slats 10 such that seat slats 10 can be mechanically rotated at any rotational displacement angle 70 ranging from 0° to 90°. The rotational displacement of the seating slats 10 is perpendicular to the central spine axis 20 with the rotation being centered on the central spine axis 20.

The rotational displacement of one seating slat 10 is mechanically transferred to the adjacent seating slat 10 by means of movement control pins 11*c* which allow the adjacent seating slat 10 to rotate at an angular rotational angle 80 which depends on the size of the movement control slot 11*b*. This rotational displacement is gradually transferred from one seating slat 10 to another seating slat 10 along the central spine axis 20 allowing each adjacent slat 10 to gradually rotate at a gradually reducing angular rotational angle 80 such that when each adjacent seating slat 10 completes the maximum rotational displacement of 90°, the angular rotational angle 80 between the adjacent slat and the previous seating slat become 0°.

The rotational displacement angle 70 is the angle formed between the initial position and the final position of the seating slats 10 when the seating slat is applied with mechanical rotational force causing the change in position of the seating slats 10. The rotational displacement angle can vary from 0° to 90°.

The angular rotational angle 80 is the angle formed between two adjacent seating slats 10 when the rotational displacement of one seating slat is mechanically transferred to the adjacent seating slat. The angular rotational angle depends of the size of the seating slat 10 and the size of the movement control slots 11*b*.

FIGS. 1-6 show a first configuration example of the bench assembly 2, where the seat slats 10 of the pivoting seat bench assembly 2 are arranged such that the entire bench forms a seating surface on one side of the bench 2. According to this configuration, the movement control pins 11*c* of the slat rotating components 24 associated to the different seat slats 10 are positioned on one side (extremity) of the movement control slot 11*b* such that the plurality of seating slats 10 form 0° rotational displacement angles 70 between them for forming the seating surface on one side of the bench assembly 2. The position of the seating slats 10 is controlled by the seating angle position stopper 15 which is physically fastened to the stand 14 by slot 26. The seat slats 10 are physically stopped and supported by the seating angle position stopper 15 for forming the 0° rotational displacement angles 70 and in consequence the flat seating surface.

FIGS. 7-12 show another configuration example where a group of the seating slats 10 are mechanically rotated from one end of the pivoting seat bench assembly 2 in an anticlockwise direction such that seating slats 10 are displaced at a rotational displacement angles varying between 0° and 90°. According to this configuration, the movement control pins 11*c* inside the movement control slots 11*b* of the adjacent seating slats 10 have respective positions to allow the respective rotational displacement angles. The rotational displacement is gradually transferred from one seating slat 10 to subsequent seating slats 10 such the seating slats 10 are finally arranged to form a second seating surface on the other side of the pivoting seat bench assembly 2.

The rotational displacement can range from a partial displacement wherein few seating slats 10 are rotated such that rotational displacement angle 70 ranges from 0° to 90° such that the seating surf ace is now partially shifted to the other side of the seat bench assembly or to a full displacement wherein all the seating slats 10 are rotated to a rotational displacement angle of 90° such that the seating surface is now completely shifted to the other side of the seat bench assembly.

FIGS. 13-18 show another configuration example where a group of the seating slats 10 are mechanically rotated from any in-between position between the two extremities of the pivoting seat bench assembly 2 in a clockwise or an anticlockwise direction such that rotated seating slats 10 are displaced at rotational displacement angles 70 varying between 0° and 90°. According to this configuration, the movement control pins 11*c* inside the movement control slots 11*b* of the adjacent seating slats 10 have respective positions to allow the rotational displacement angles. The rotational displacement is gradually transferred from one seating slat 10 to subsequent seating slats 10 such that the seating slats 10 are arranged to form a second seating surface on the other side of the pivoting seat bench assembly.

The rotational displacement can range from a partial displacement wherein some seating slats 10 are rotated partially with rotational displacement angles 70 varying between 90° to 0° resulting in the seating surface being partially shifted to the other side of the seat bench assembly, or to a full displacement wherein the seating slats 10 are rotated completely with rotational displacement angles 70 of 90° resulting in the seating surface formed by these completely shifted slats being completely shifted to the other side of the seat bench assembly 2.

FIGS. 19-24 show another configuration example where a group of seating slats 10 are mechanically rotated from other end of the pivoting seat bench assembly in a clockwise direction such that first seating slats 10 are displaced at rotational displacement angles 70 varying between 0° and 90°. According to this configuration, the movement control pins 11*c* inside the movement control slots 11*b* of the adjacent seating slats 10 have respective positions to allow the rotational displacement angles.

The rotational displacement is gradually transferred from one seating slat 10 to subsequent seating slats 10 such that the seating slats 10 are arranged to form a second seating surface on the other side of the pivoting seat bench assembly.

The rotational displacement can range from a partial displacement wherein some seating slats 10 are rotated partially with rotational displacement angles 70 varying between 0° to 90° resulting the s eating surface being partially shifted to the other side of the seat bench assembly 2, or to a full displacement wherein all the seating slats 10 are rotated completely with a rotational displacement angle 70 of 90° resulting in the seating surface formed by these completely shifted slats being completely shifted to the other side of the seat bench assembly 2.

Figure 25:
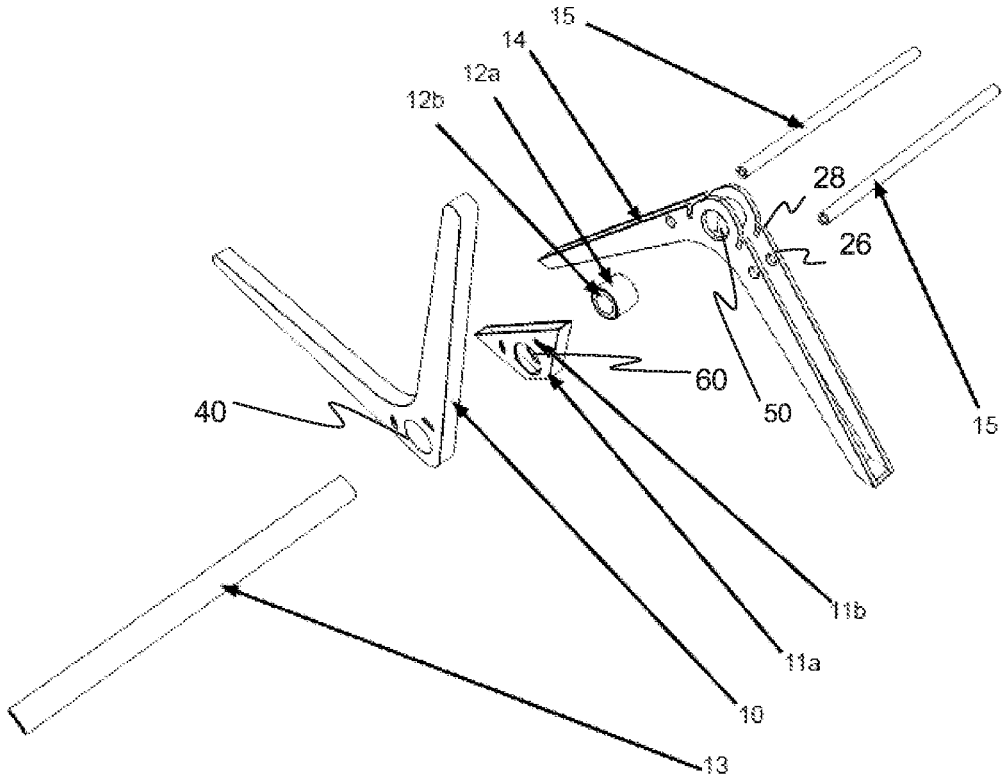
FIG. 25 is a first side exploded view of components of pivoting seat bench assembly according to one embodiment of the present invention.
Figure 26:
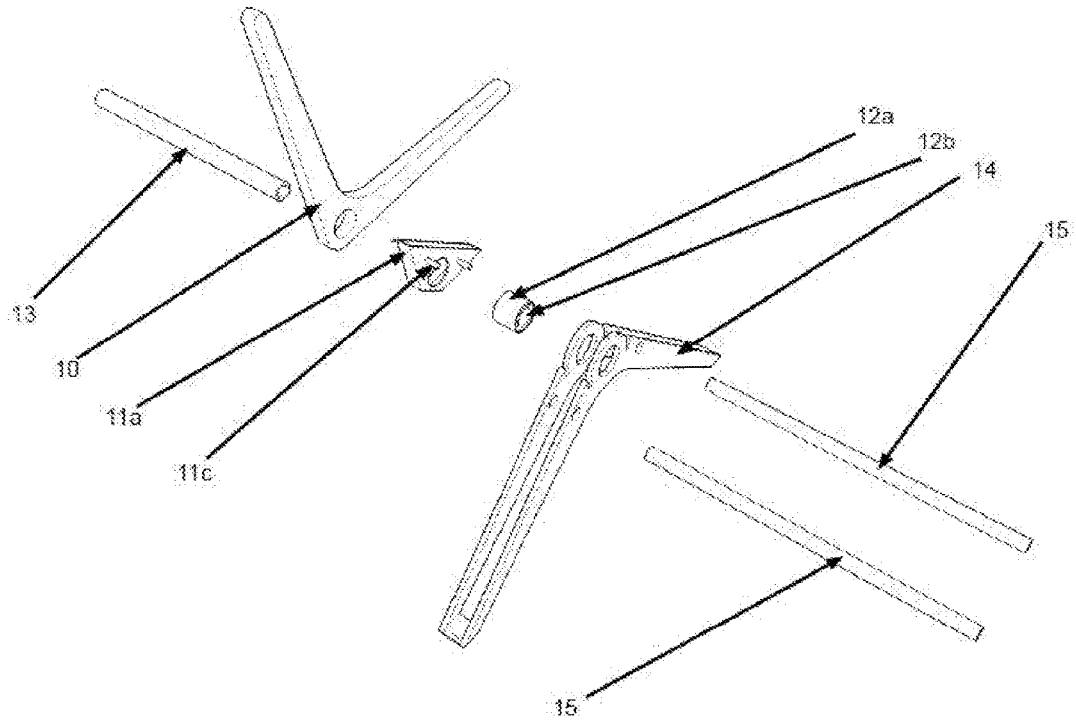
FIG. 26 is a second side exploded view of components of pivoting seat bench assembly according to one embodiment of the present invention.
Figure 27:
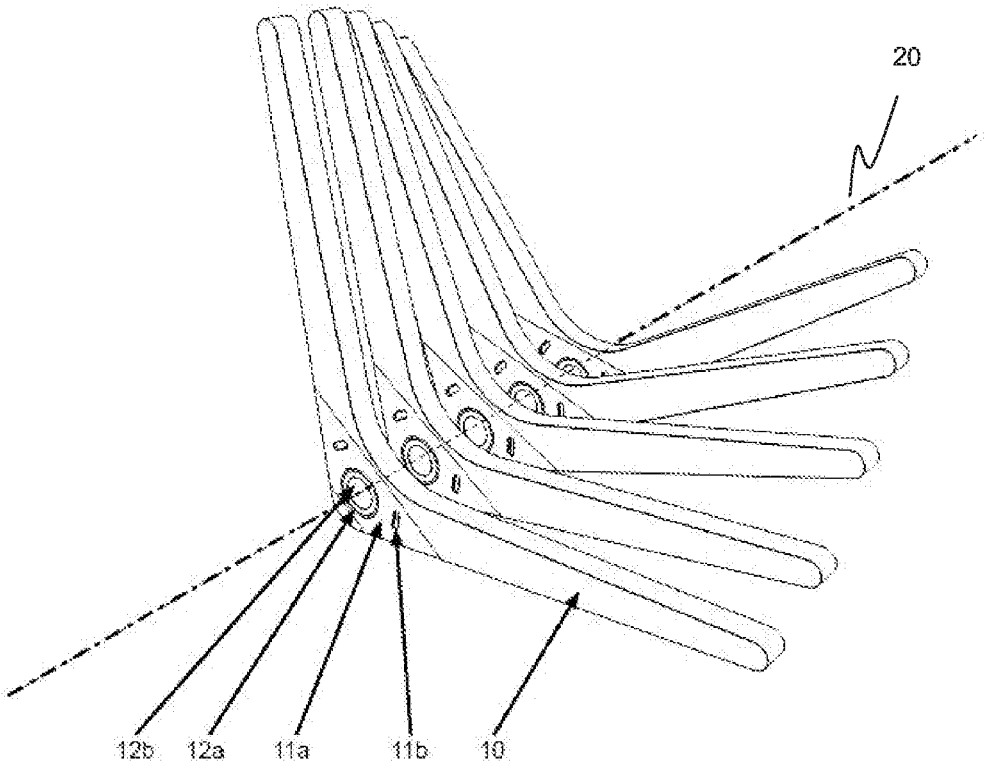
FIG. 27 is a first side exploded view of seat slats interlinked along the central spine axis showing the relative rotational displacement of seat slats is perpendicular to the central spine axis with the rotation being centered on the central spine axis according to one embodiment of the present invention.
Figure 28:
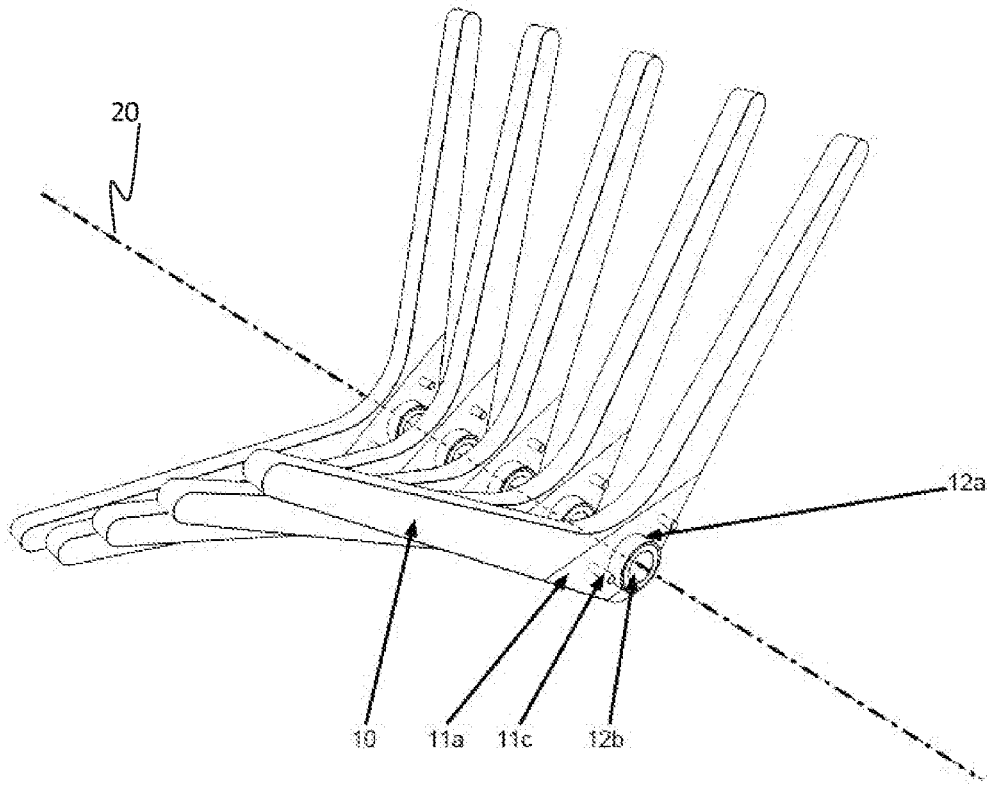
FIG. 28 is a second side exploded view of seat slats interlinked along the central spine axis showing the relative rotational displacement of seat slats is perpendicular to the central spine axis with the rotation being centered on the central spine axis according to one embodiment of the present invention.
Figure 29:
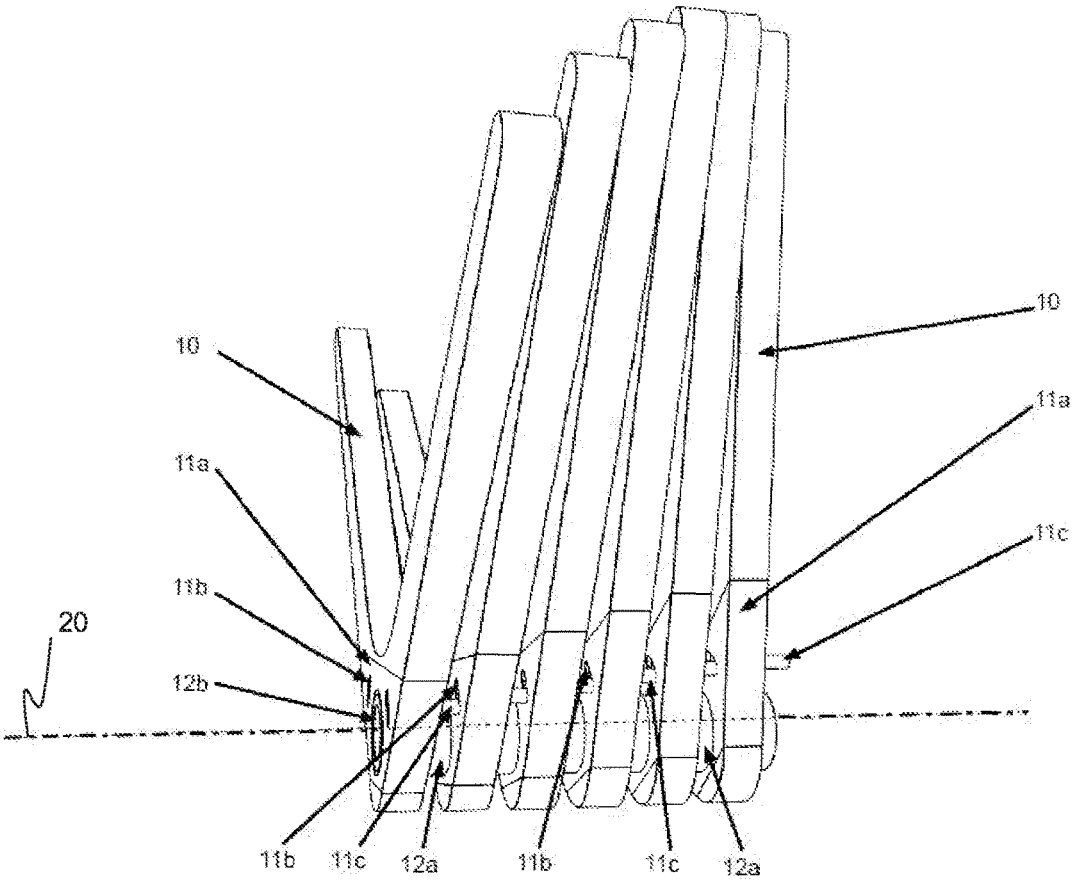
FIG. 29 is a rear perspective view showing relative rotational displacement of seat slats along the central spine axis, the slats being interconnected such that the movement control pin of slat-rotating component of one slat is protruding onto the movement control slot of the slat-rotating component of the adjacent slat according to one embodiment of the present invention.
Figure 30:
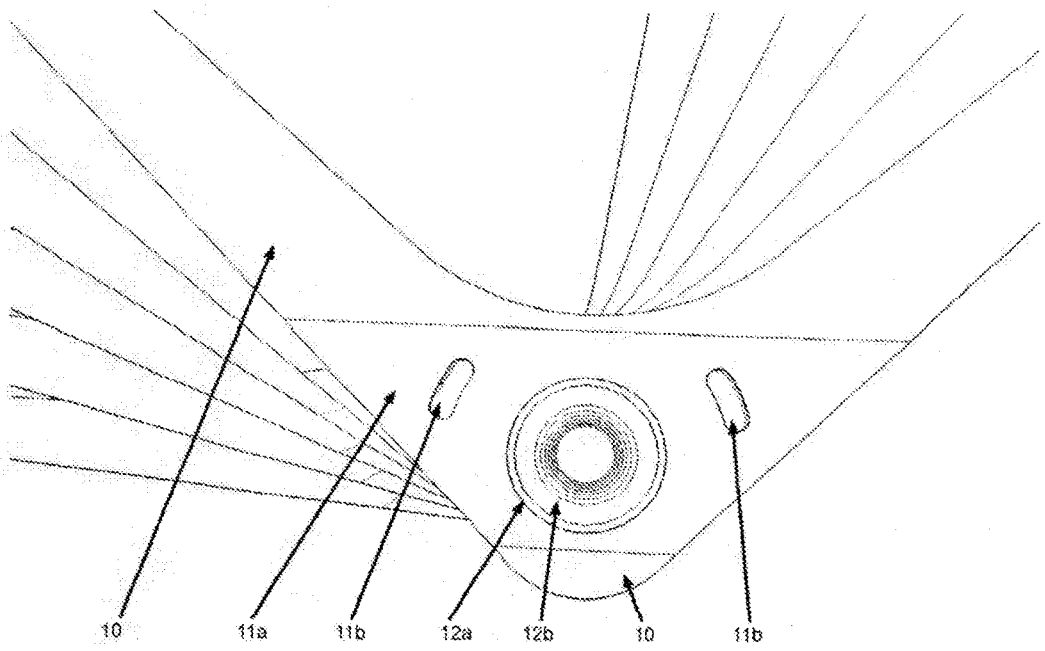
FIG. 30 is a first translucent perspective view of showing relative rotational displacement by means of movement control pin and movement control slot according to one embodiment of the present invention.
Figure 31:
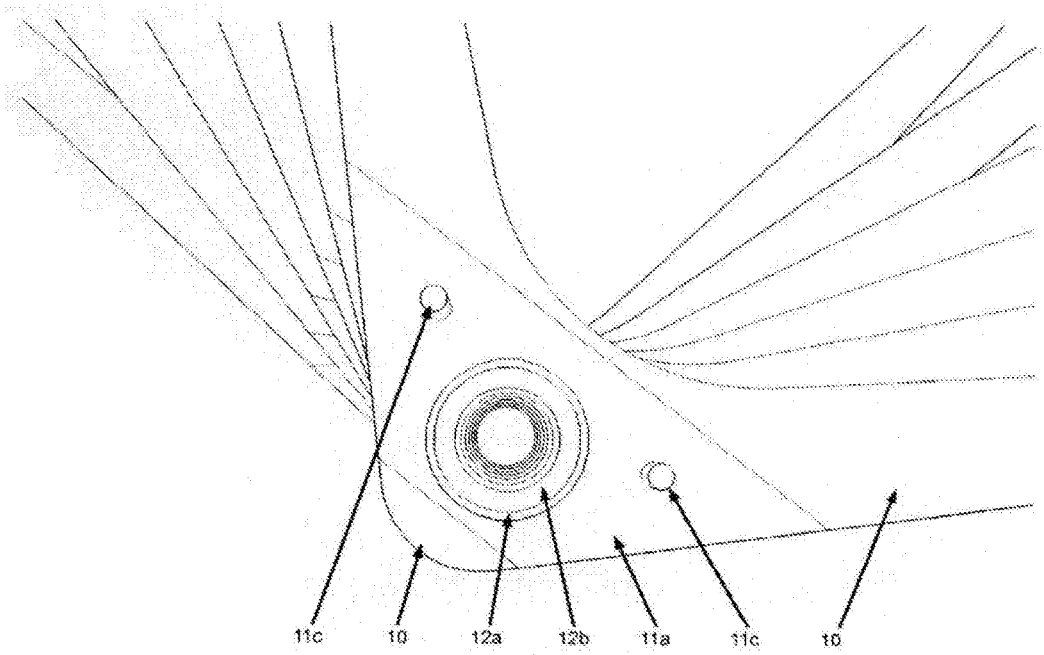
FIG. 31 is a second translucent perspective view of showing relative rotational displacement by means of movement control pin and movement control slot according to one embodiment of the present invention.
Figure 32:
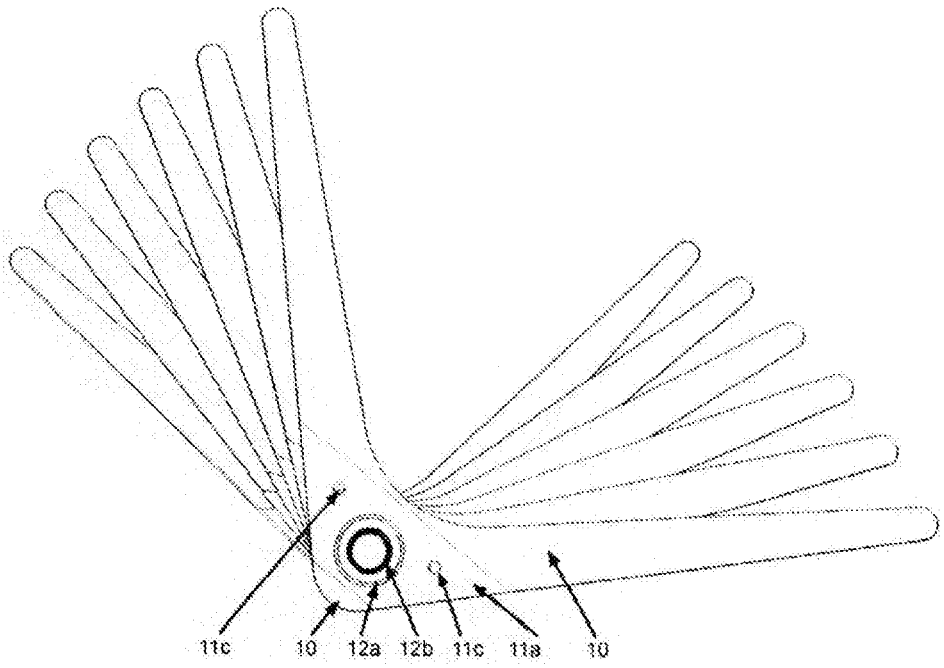
FIG. 32 is a third translucent perspective view of showing relative rotational displacement by means of movement control pin and movement control slot according to one embodiment of the present invention.
Figure 33:
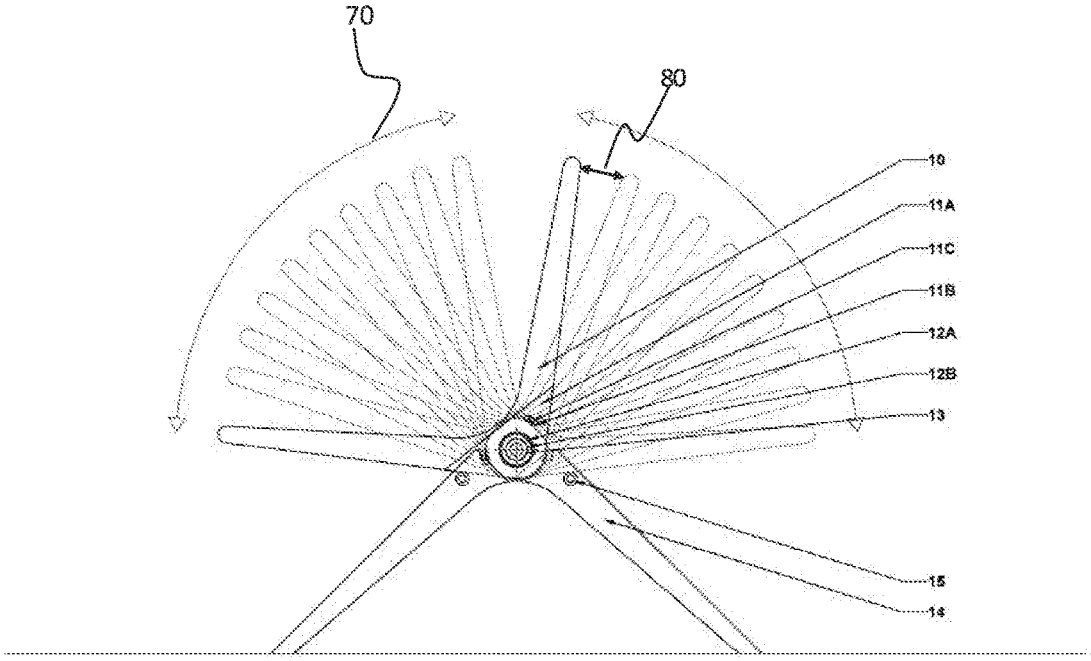
FIG. 33 is a side elevation view of the assembled seat bench assembly according to one embodiment of the present invention.
Figure 34:
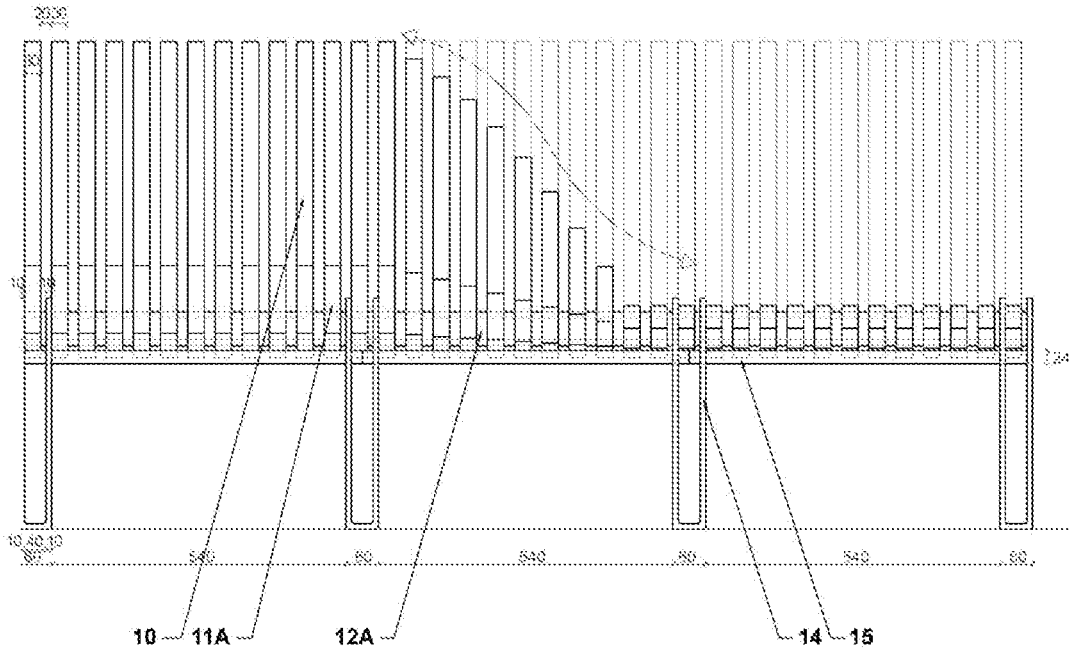
FIG. 34 is a front elevation view of the assembled seat bench assembly according to one embodiment of the present invention.
Figure 35A:
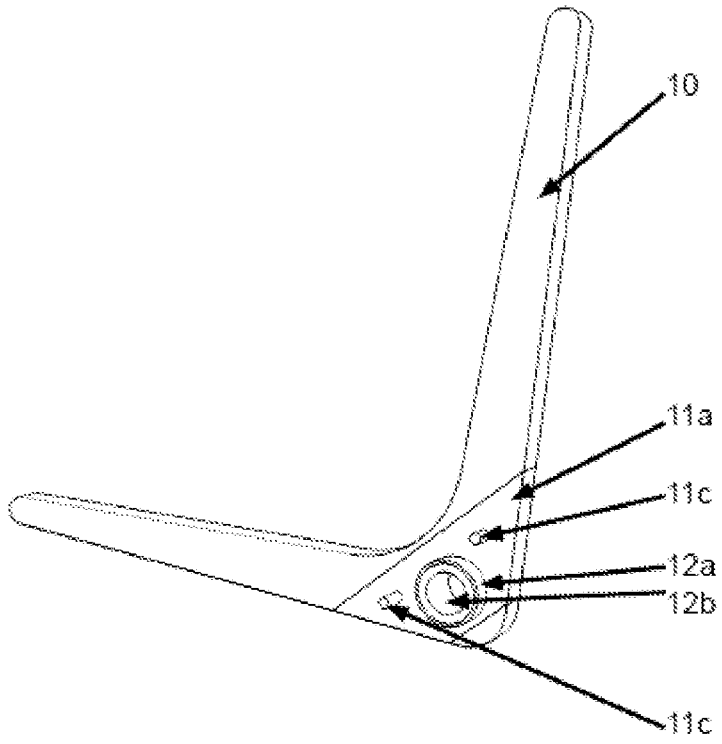
FIG. 35*a*) is a first side perspective view of seat slats and slat-rotating component according to one embodiment of the present invention.
Figure 35B:
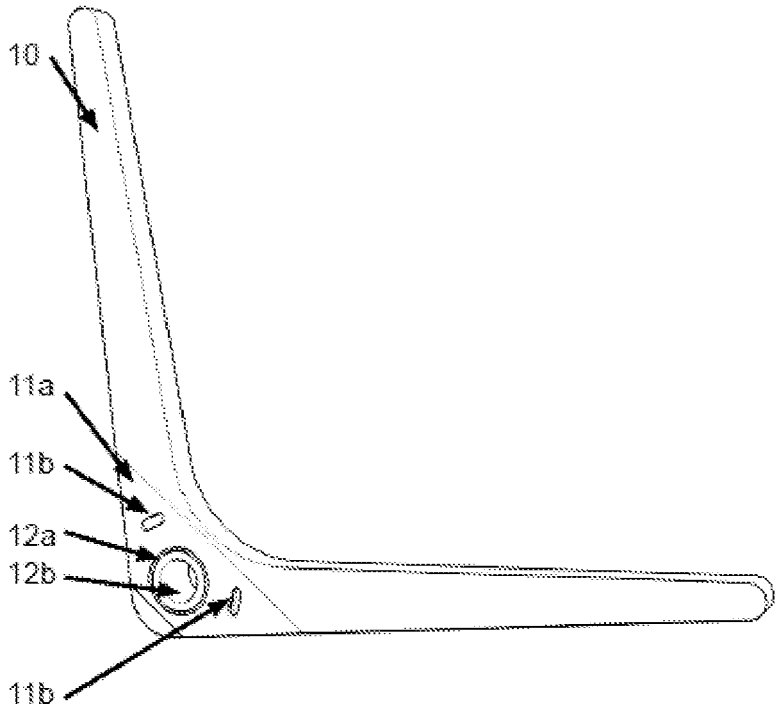
FIG. 35*b*) is a second side perspective view of seat slats and slat-rotating component according to one embodiment of the present invention.
Figure 35C:
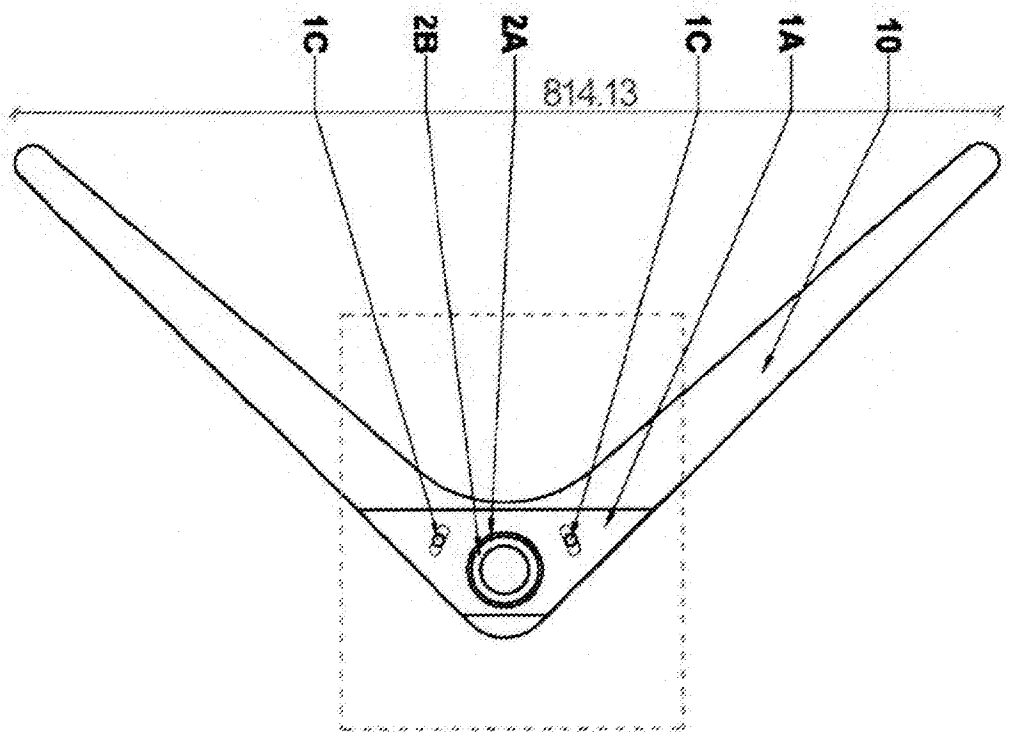
FIG. 35*c*) is a first side elevation view of seat slats and slat-rotating component according to one embodiment of the present invention.
Figure 35D:
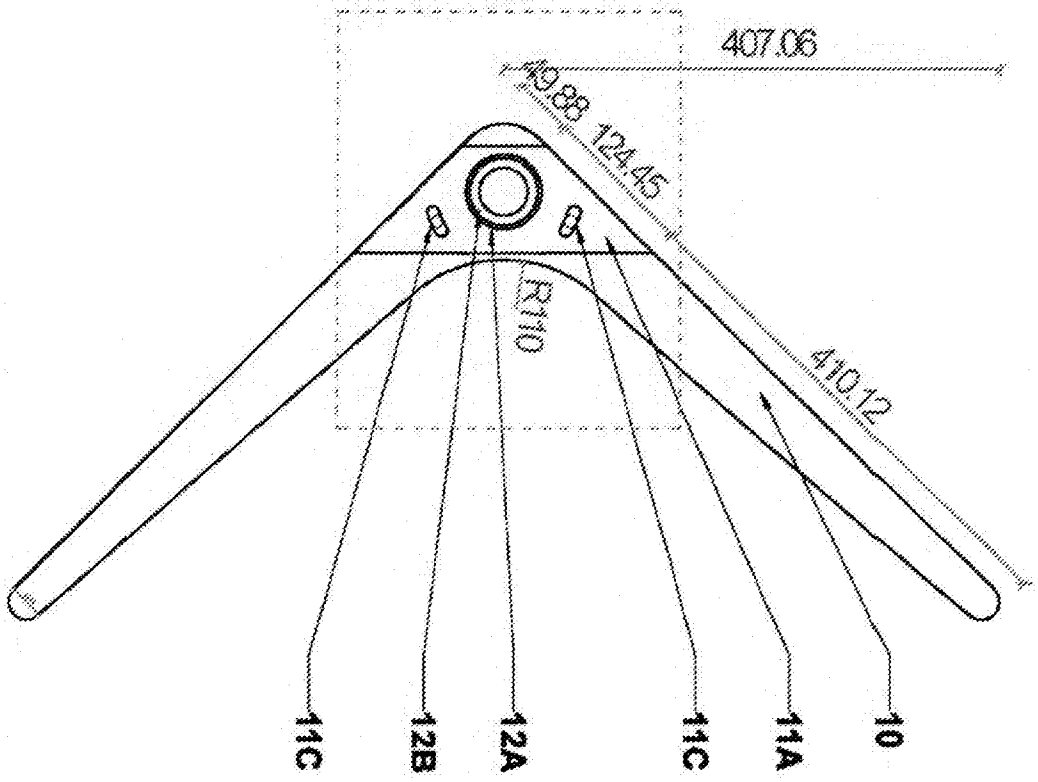
FIG. 35*d*) is a second side elevation view of seat slats and slat-rotating component according to one embodiment of the present invention.
Figure 35E:
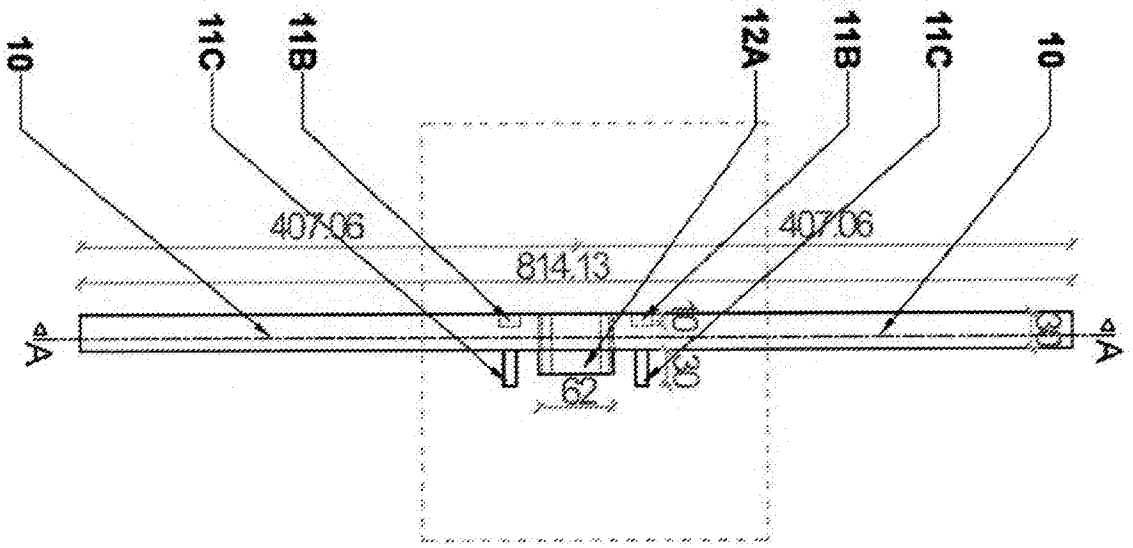
FIG. 35*e*) is a front elevation view of seat slats and slat-rotating component according to one embodiment of the present invention.
Figure 35F:
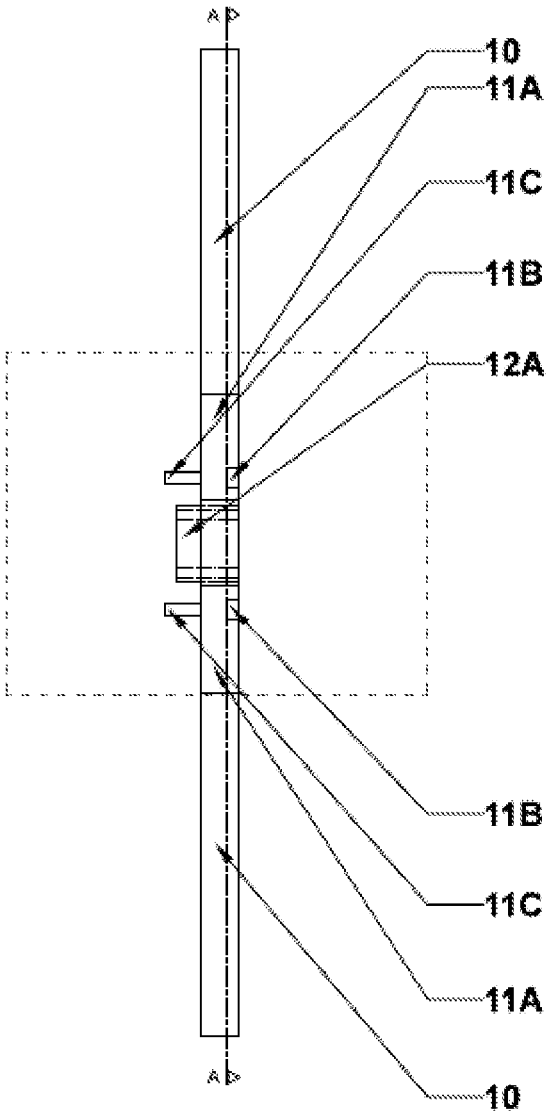
FIG. 35*f*) is a back elevation view of seat slats and slat-rotating component according to one embodiment of the present invention.
Figure 36A:
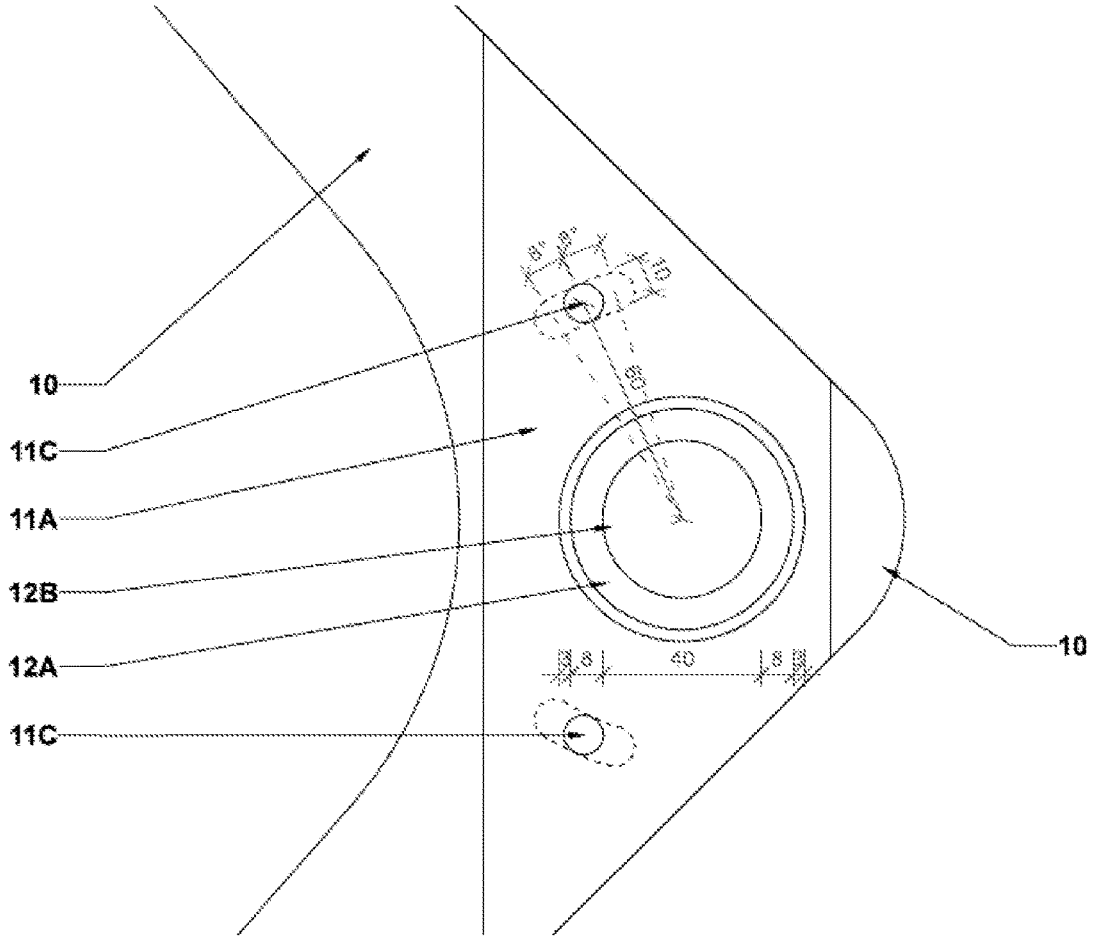
FIG. 36*a*) is a first side elevation view showing the details of mechanical rotation joint between the central spine structure and the seating slats according to one embodiment of the present invention.
Figure 36B:
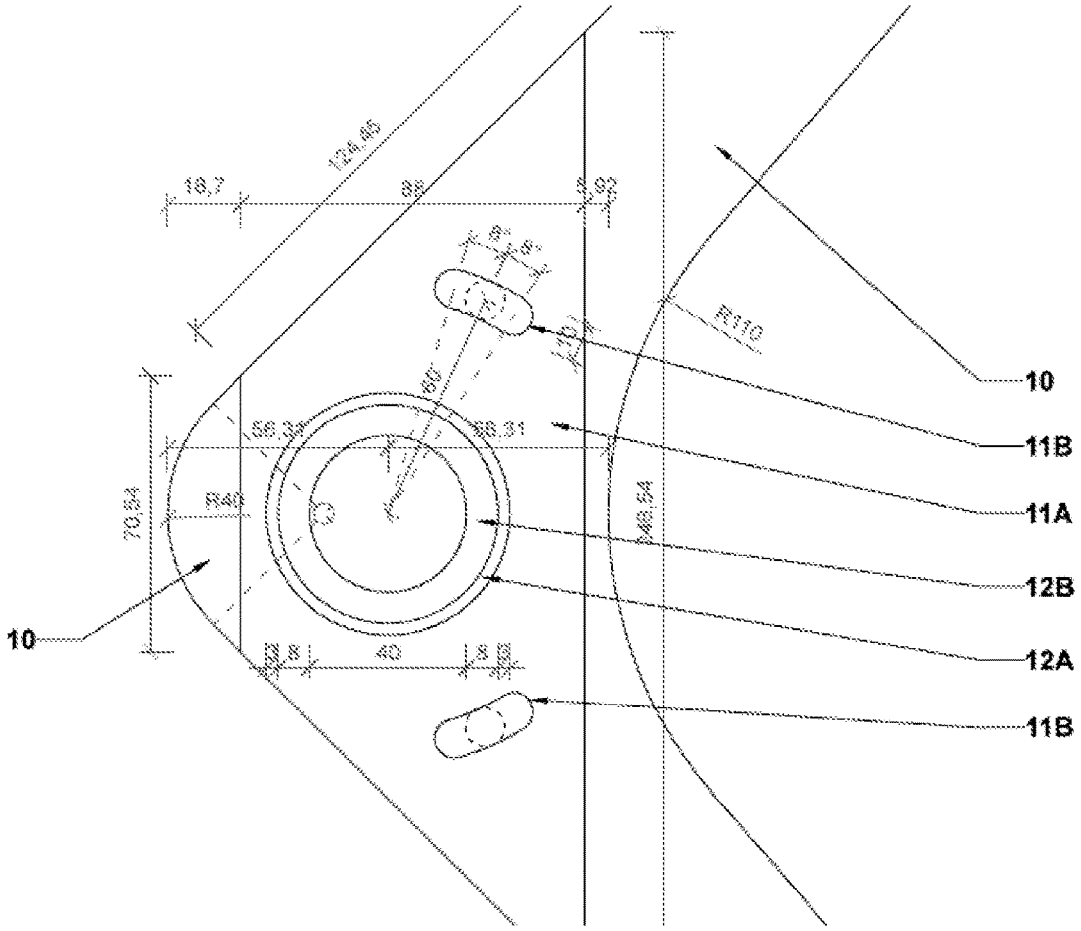
FIG. 36*b*) is a second side elevation view showing the details of mechanical rotation joint between the central spine structure and the seating slats according to one embodiment of the present invention.
Figure 36C:
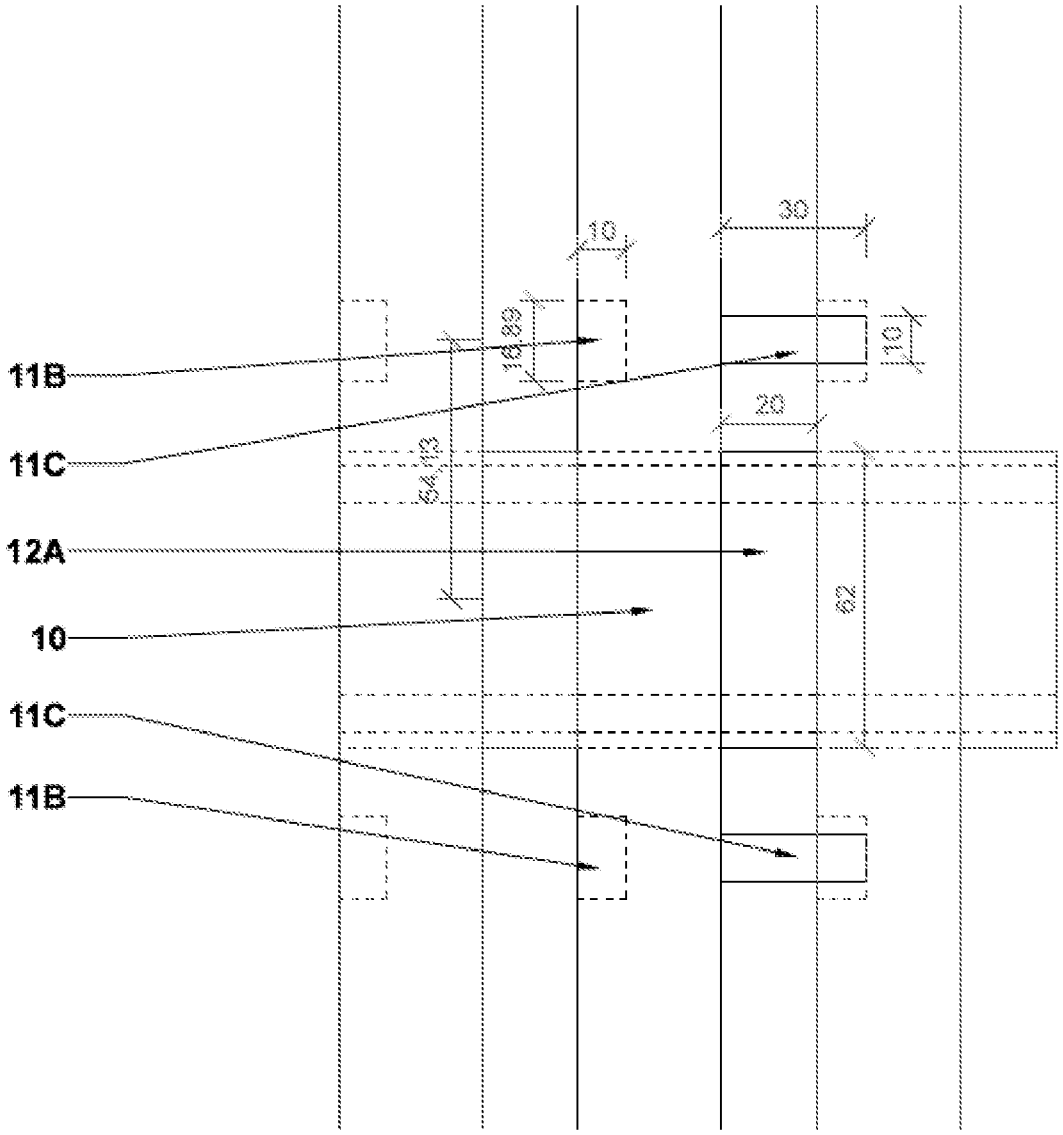
FIG. 36*c*) is a front elevation view showing the details of mechanical rotation joint between the central spine structure and the seating slats according to one embodiment of the present invention.
Figure 36D:
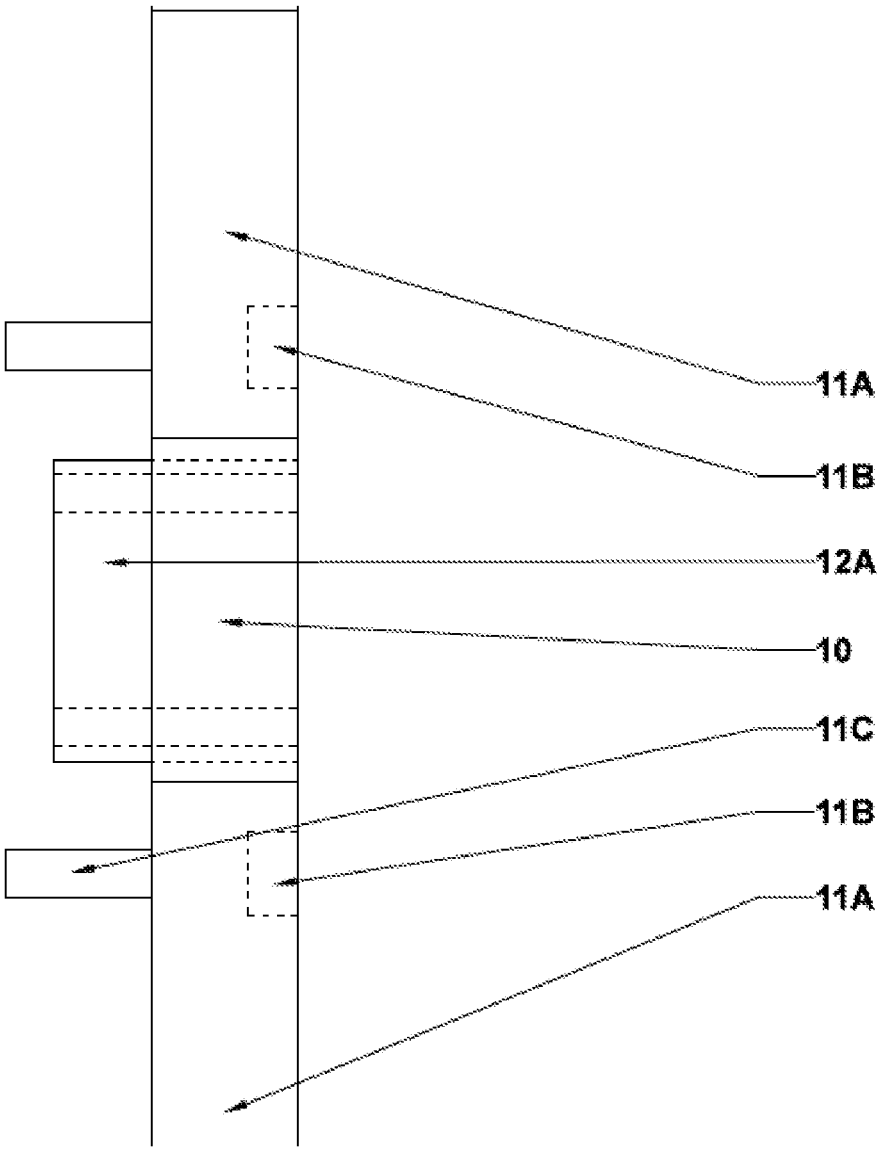
FIG. 36*d*) is a back elevation view showing the details of mechanical rotation joint between the central spine structure and the seating slats according to one embodiment of the present invention.

As illustrated in FIGS. 25 and 26, during the assembly of the pivoting bench assembly 2, each one of the seating slat 10 is respectively placed inside the cavity of the associated sleeve component 11 such that the hole 40 of the seating slat 10 is coinciding to the hole 60 of the sleeve component 11 and such that the rotating bearing structure 12 is placed inside the holes 40 & 60 such that the external cladding 12*a* is firmly fixed to the coinciding holes and the internal bearing 12*b* is physically connected to the external cladding 12*a* from the outside and forms a central spine hole 30 on the inside to allow the central spine 13 to pass through. The seating angle position stopper 15 is coupled to the stands 14 by either inserting the stopper in a slot 26 configured on the stand 14 or by any other means.

Referring to FIGS. 27-34, each seating slat 10 is connected to a corresponding slat rotating component 24 to form a mechanical rotation joint between the central spine 13 and the seating slat 10. The seating slats 10 are mechanically rotated clockwise or anticlockwise along the central spine axis 20. The rotation of one seating slat 10 engages the rotation of an adjacent seating slat 10 which in turn engages the rotation of an adjacent seating slat and so on. This is because the seated slats 10 are interlinked to each other by means of the slat rotating components 24 where the movement control pin 11*c* of one seating slat rotating component 24 protrudes into the movement control slot 11*b* of an adjacent slat rotating component 24.

The mechanical rotational displacement of any one of the seating slats 10 causes the movement control pin 11*c* attached to that seating slat 10 to move inside the movement control slot 11*b* of the adjacent slat in the direction of rotation causing the adjacent slat to rotate in the direction of rotation with an angular rotational angle 80 formed between the first slat and the adjacent slat.

The angular rotational angle 80 is formed depending on the size of the seating slat 10 and the size of the movement control slot 11*b* which decides the available distance for the free movement of the movement control pins 11*c* before reaching the end of the movement control slot 11*b* and pulling/forcing the adjacent seating slat 10 to rotate in the same direction.

Preferably, the movement control pin 11*c* of the terminal seating slats 10 which are physically connected to the stand 14 locks the rotational displacement of seating slat 10 by fixing itself in the cuts 28 available on the stand 14. The seating slats 10 are further structurally supported by the seating angle position stopper 15 which holds the seating slats 10 to form the seating surface on either side of the bench.

Referring to FIGS. 35*a* to 35*f*, the slat rotating component 24 is physically attached to the seating slats 10 such that the seating slat 10 is inserted in the cavity of the sleeve component 11 such that the hole 40 of the seating slat 10 coincides with the hole 50 of the outer cladding sheet 11*a* where the movement control pin 11*c* is on one side and the movement control slot 11*b* is on the other side of the sleeve component 11. The movement control pin 11*c* of one sleeve component 11 is protruding inside the movement control slot 11*b* of the adjacent sleeve component 11 thereby interlinking the seating slats 10 and allowing the gradual transfer of mechanical rotational displacement. The internal bearing 12 of the slat rotating component 24 is physically placed inside the coinciding holes of the seating slat 10 and the outer cladding sheet 12*a* such that the internal bearing 12*b* is physically connected from the outside to the external cladding 12*a* and forms a central spine hole 30 on the inside to allow the central spine structure 13 to pass through.

The seating slats 10 are preferably made by any suitable material which has sufficient strength and comfort to provide a stable seating surface and back surface of the seat bench assembly 2. The suitable examples of the material used for seating slats 10 includes but not limited to metals, wood and hard plastics.

Referring to FIGS. 36*a* to 36*d*, the angular rotational angle 80 is exemplified as up to 8° when the width of the movement control slot 11*b* is 10 inches. The figures further exemplify various measurements of the components of the pivoting seat bench assembly. However, a person skilled in the art will appreciate that such measurements can vary with the change in the shape and size of the individual components and overall size of the pivoting seat bench assembly 2.

Figure 37:
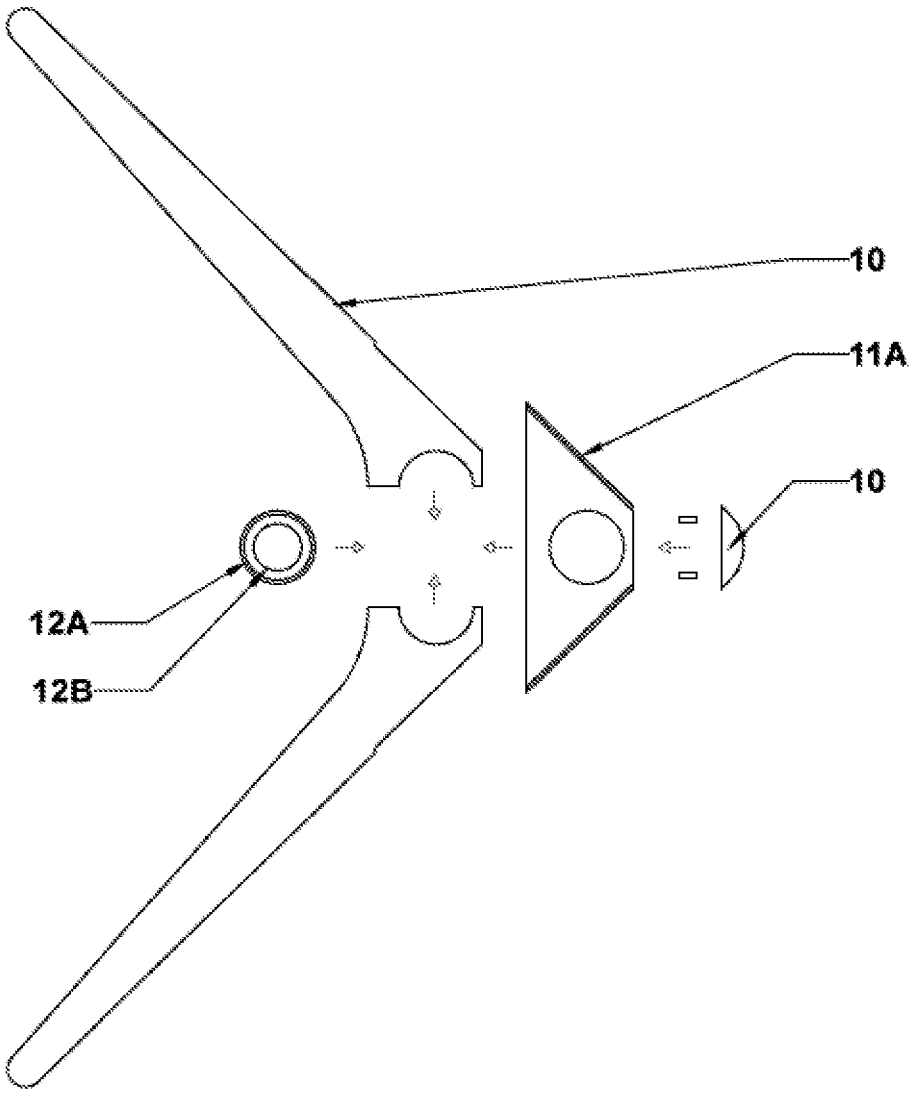
FIG. 37 is an exploded view of the components of pivoting seat bench assembly according to one embodiment of the present invention.
Figure 38A:
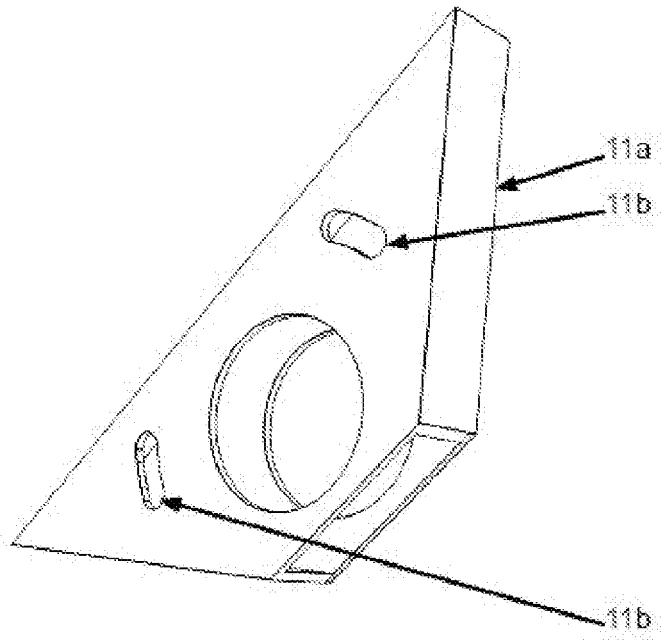
FIG. 38*a*) is a first side perspective view of sleeve component according to one embodiment of the present invention.
Figure 38B:
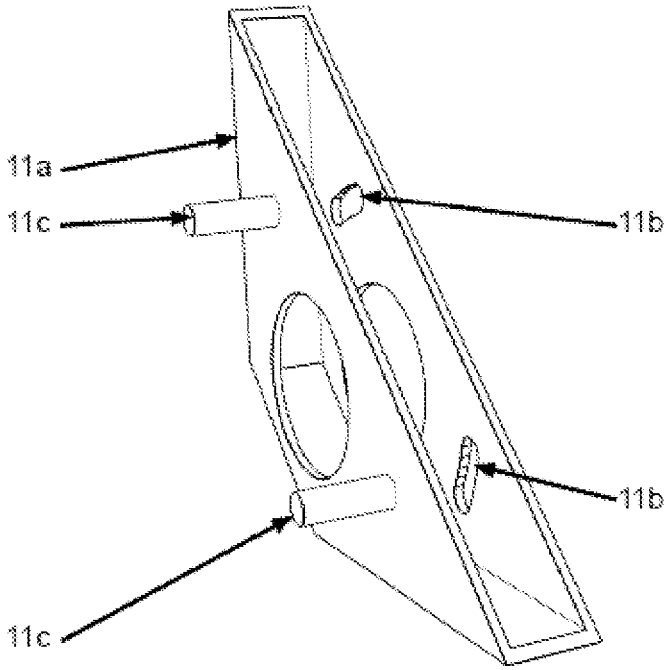
FIG. 38*b*) is a second side perspective view of sleeve component according to one embodiment of the present invention.
Figure 38C:
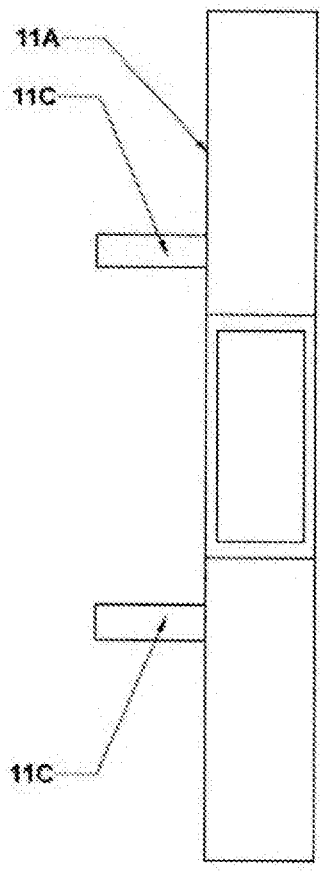
FIG. 38*c*) is a back elevation view of sleeve component according to one embodiment of the present invention.
Figure 38D:
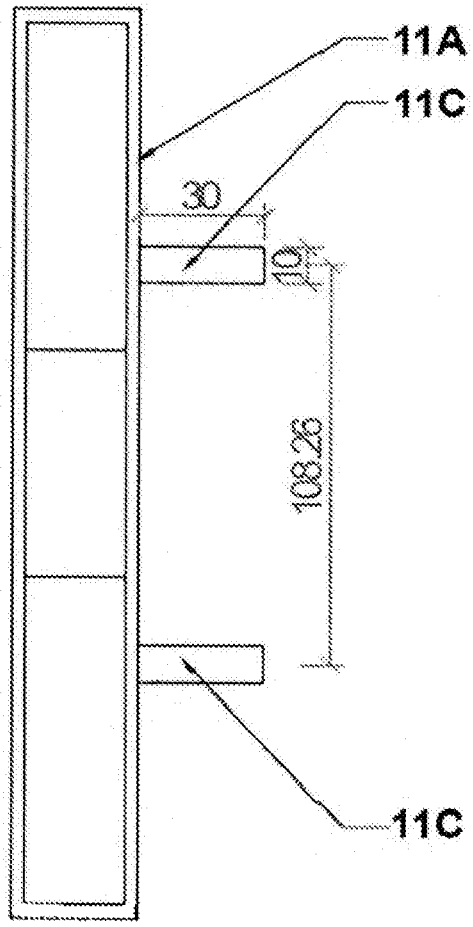
FIG. 38*d*) is a front elevation view of sleeve component according to one embodiment of the present invention.
Figure 38E:
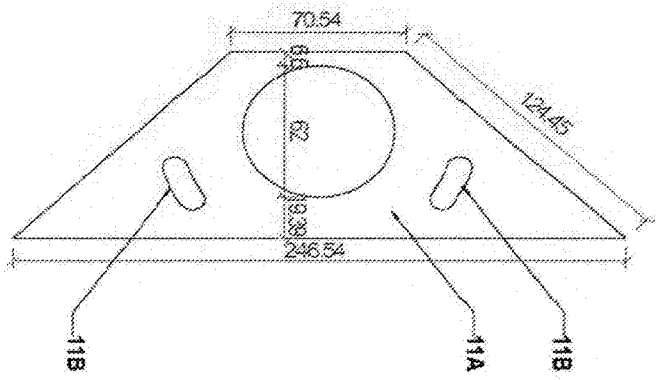
FIG. 38*e*) is a first side elevation view of sleeve component according to one embodiment of the present invention.
Figure 38F:
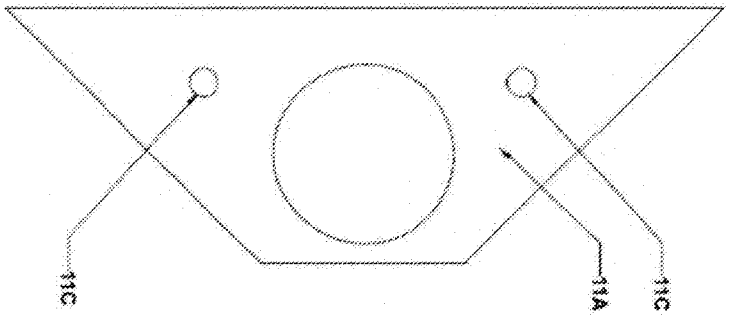
FIG. 38*f*) is a second side elevation view of sleeve component according to one embodiment of the present invention.

Referring to FIG. 37, the seating slat 10 is physical connected to the slat rotating component 24 to form a mechanical rotation joint of the pivoting seat bench assembly 2.

Referring to FIGS. 38*a* to 38*f*, the sleeve component 11 is preferably made by any suitable material which has sufficient strength to provide structural support to hold the seating slats 10. The suitable examples of the material used for stands includes but not limited to metals, wood and hard plastics. The sleeve component 11 is preferably made by interconnected double sheet such that a cavity if formed to hold the seating slats 10. The measurements are also exemplified in the figures. However, a person skilled in the art will appreciate that such measurements can vary with the change in the shape and size of the individual components and overall size of the pivoting seat bench assembly.

Figure 39A:
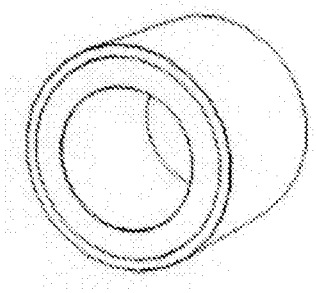
FIG. 39*a*) is a perspective view of rotating bearing structure according to one embodiment of the present invention.
Figure 39B:
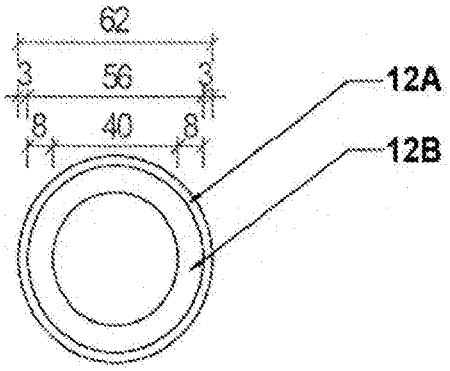
FIG. 39*b*) is a side elevation view of rotating bearing structure according to one embodiment of the present invention.
Figure 39C:
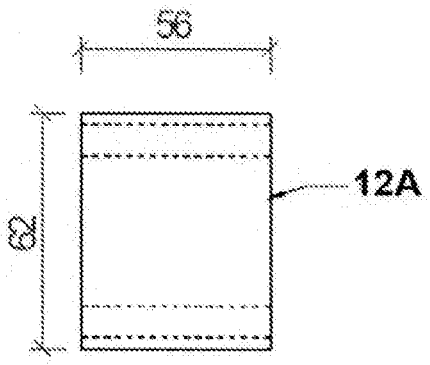
FIG. 39*c*) is a front/back elevation view of rotating bearing structure according to one embodiment of the present invention.

Referring to FIGS. 39*a* to 39*c*, the internal bearing 12 is preferably made of suitable material according to the mechanical functions of each part. The external cladding 12*a* is preferably made of metal and the internal bearing 12*b* is preferably a nylon bearing. However, any other suitable materials which fulfill the purpose of the components are within the scope of the invention. The measurements are also exemplified in the figures. However, a person skilled in the art will appreciate that such measurements can vary with the change in the shape and size of the individual components and overall size of the pivoting seat bench assembly.

Figure 40:
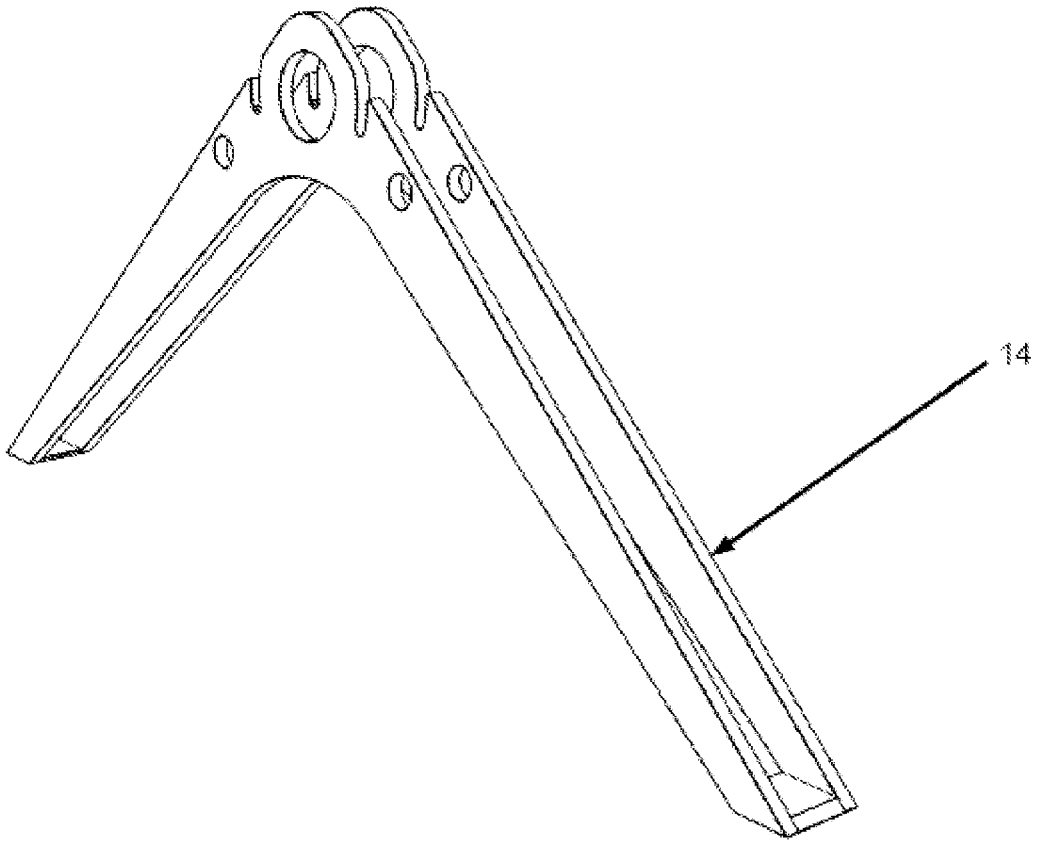
FIG. 40*a*) is a perspective view of stand showing interconnected double sheet according to one embodiment of the present invention.
FIG. 40*b*) is a side elevation view of stand according to one embodiment of the present invention.
FIG. 40*c*) is a front elevation view of stand according to one embodiment of the present invention.
Figure 40B:
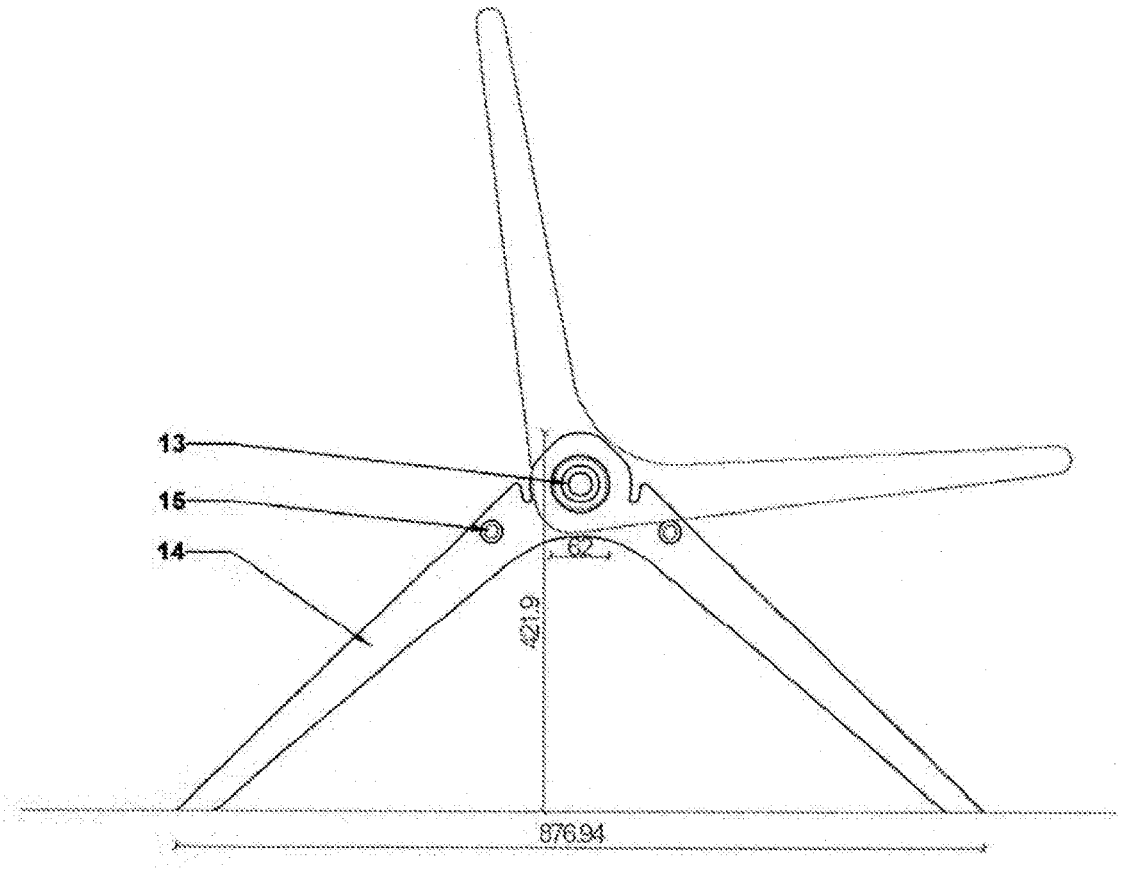
Figure 40C:
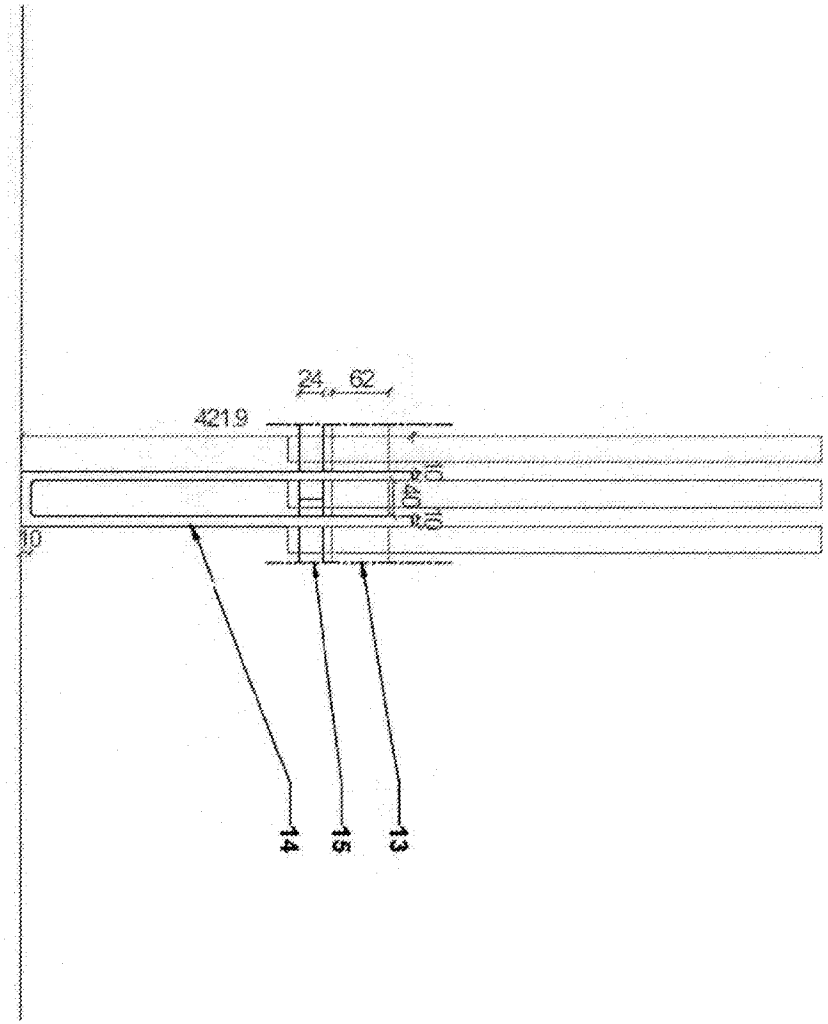

Referring to FIGS. 40*a* to 40*c*, the stand 14 is preferably made by any suitable material which has sufficient strength to provide structural support to hold the seat bench assembly 2 on the floor surface. The suitable examples of the material used for stands 14 includes but not limited to metals, wood and hard plastics. The stand 14 is preferably made by interconnected double sheet to enhance the overall strength of the stand. The measurements are also exemplified in the figures. However, a person skilled in the art will appreciate that such measurements can vary with the change in the shape and size of the individual components and overall size of the pivoting seat bench assembly.

SUMMARY DESCRIPTION OF COMPONENTS ACCORDING TO AN EMBODIMENT OF THE INVENTION

Component 10: (Timber/Plastic/Metal Etc) Boomerang Shape Elements (Seat Slats)
- 8 degrees limited relative rotation to each other
- Seating and back support
- Can be rotated to each side seating around the spine Component 11: (Metal) Sleeves
- Attached to each boomerang shape elements
- includes interlinking mechanical rotation movement joint (boomerang shape elements rotation angle control to max 8 degrees relative to each other)
- Added for structural strength
- 3 mm thick metal cladding with metal pin accessories attached to its surface
- Sleeve's surface is flush with boomerang surface
- Sub-Components:
- 11A: Metal cladding sheet/sleeve
- 11B: Movement moment slot
- 11C: Movement moment pin Component 12: (Nylon) Bearings with External (Metal) Tube Cladding
- includes mechanical rotation movement joint (between central structural spine pipe and boomerang shape elements)
- Nylon bearing fixed to external metal ring support
- Attached to the metal sleeve within the central spine hole of the boomerang shape
- Creates smooth rotation around the spine pipe element
- Sub-Components:
- 12A: Metal ring/external cladding
- 12B: nylon ring/internal nylon bearing Component 13: (Metal) Spine Pipe Structural Element (Central Spine)
- Structural component interlinking the boomerang shape elements with a regular distance
- Connected to the metal legs at its ends
- Boomerang shape elements are sitting on it interlinking to each other and rotating around this spine Component 14: (Metal) Structural Legs (Stands)
- Placed at regular distances to hold the spine pipe and the boomerang shape elements
- The seating angle position stopper structural pipe element is fixed to this at its ends Component 15: (Metal) Seating Angle Position Stopper Structural Pipe Element
- Structural support for the boomerang shape elements at seating level angle
- Sitting between the metal legs
- Sits on both sides of the legs symmetrically along the central spine axis Component 22: Slat-Rotating Component

The invention claimed is:

1. A pivoting bench comprising:
- a central spine extending along a longitudinal axis;
- seat slats configured to be mounted to the central spine and to rotate about the longitudinal axis for alternating a seating surface formed by at least a part of the seat slats from a first side of the bench to a second side of the bench opposite the first side with respect to the longitudinal axis of the central spine;
- a support structure for supporting the central spine, the seat slats and the bench to the ground; and
- a stopper respectively for each side of the bench mountable on the support structure and extending along the longitudinal axis for stopping and supporting the seat slats when they reach a sitting position.

2. The pivoting bench of claim 1, wherein the seat slats are boomerang-shaped seat slats.

3. The pivoting bench of claim 1, wherein the seat slats are configured to have a predefined displacement angle range therebetween while rotating.

4. The pivoting bench of claim 3, wherein the seat slats comprise pins and slots adapted to link the seat slats between each other in a manner to enable a coordinated movement therebetween according to the predefined displacement angle range.

5. The pivoting bench of claim 4 wherein each seat slat has two pins on a first side of the slat adjacent a first proximity slat and two slots on another side of the slat adjacent a second proximity slat, wherein the pins of the slat are adapted to engage the slots of the first proximity slat and the slots of the slat are adapted to engage the pins of the second proximity slat.

6. The pivoting bench of claim 5, wherein the seat slats are adapted to be coupled to the central spine using slat rotating components.

7. The pivoting bench of claim 6, wherein the seat slats have bend portions, and wherein the slat rotating components are adapted to enrobe the bend portions of the slats.

8. The pivoting bench of claim 7, wherein the predefined displacement angle range is 0-8 degrees.

9. The pivoting bench of claim 8, wherein the seat slats are adapted to rotate between 0 and 90 degrees.

10. The pivoting bench of claim 9, wherein a 90 degrees rotation of the seat slats results in shifting the seating surface formed by the rotated seat slats from the first side of the bench to the second side of the bench.

11. The pivoting bench of claim 10, wherein the central spine consists of a cylindrical shaft extending along the longitudinal axis.

12. The pivoting bench of claim 11, wherein the stoppers consist of cylindrical shafts extending along the longitudinal axis.

13. The pivoting bench of claim 12, wherein the support structure comprises two or more stands adapted to sit on the ground and to support the central spine and the stoppers.

14. The pivoting bench of claim 1, wherein the seat slats are divided into 2 or more groups, such that each group of slats are interlinked independently of the other groups for forming respective 2 or more sitting areas within the bench.

15. The pivoting bench of claim 1, wherein the plurality of seating slats are adapted to be connected together in such a manner that the rotation of one or more seat slats triggers the rotation of one or more other seat slats with a predefined angular displacement there between.

16. The pivoting bench of claim 15, wherein the seat slats are adapted to rotate between 0 and 90 degrees and wherein a 90 degrees rotation of the seat slats results in shifting the seating surface formed by the rotated seat slats from the first side of the bench to the second side of the bench.

17. The pivoting bench of claim 16, wherein the displacement angle range defined between the slats enable for the slats located adjacent the 90 degrees rotated ones to form a gradually inclined slat separator.

18. The pivoting bench of claim 17, wherein the seat slats are adapted to be rotated such that 2 or more sitting areas are formed separated by gradually inclined slat separators within the bench.

19. The pivoting bench of claim 18, wherein the seat slats are boomerang-shaped seat slats.

* * * * *